US011326399B2

(12) United States Patent
Gleitman et al.

(10) Patent No.: US 11,326,399 B2
(45) Date of Patent: May 10, 2022

(54) DOWNHOLE RECONFIGURATION OF PULSED-POWER DRILLING SYSTEM COMPONENTS DURING PULSED DRILLING OPERATIONS

(71) Applicants: Halliburton Energy Services, Inc., Houston, TX (US); Chevron U.S.A. Inc., San Ramon, CA (US); SDG LLC, Minden, NV (US)

(72) Inventors: Daniel D. Gleitman, Houston, TX (US); William M. Moeny, Bernalillo, NM (US)

(73) Assignees: HALLIBURTON ENERGY SERVICES, INC., Houston, TX (US); CHEVRON U.S.A. INC., San Ramon, CA (US); SDG LLC, Minden, NV (US)

( * ) Notice: Subject to any disclaimer, the term of this patent is extended or adjusted under 35 U.S.C. 154(b) by 0 days.

(21) Appl. No.: 17/363,590

(22) Filed: Jun. 30, 2021

(65) Prior Publication Data

US 2021/0324683 A1 Oct. 21, 2021

Related U.S. Application Data

(63) Continuation of application No. 16/421,251, filed on May 23, 2019, now Pat. No. 11,078,727.

(51) Int. Cl.
*E21B 7/15* (2006.01)
*E21B 49/00* (2006.01)
(Continued)

(52) U.S. Cl.
CPC ..... *E21B 7/15* (2013.01); *E21B 44/00* (2013.01); *E21B 49/005* (2013.01);
(Continued)

(58) Field of Classification Search
CPC ... E21B 7/15; E21B 7/04; E21B 47/12; E21B 47/00; E21B 44/00; E21B 49/00;
(Continued)

(56) References Cited

U.S. PATENT DOCUMENTS 4,741,405 A 5/1988 Moeny et al.
7,959,094 B2 6/2011 Moeny
(Continued)

FOREIGN PATENT DOCUMENTS

WO 2006/023998 3/2006
WO 2008/003092 1/2008
(Continued)

OTHER PUBLICATIONS

Rohwein et al "An scr-switched, high voltage, high gain linear transformer system," Sandia National Lab. (SNL-NM), Albuquerque, NM (United States), Institute of Electrical and Electronics Engineers pulsed power conference, Monterey, CA, USA, Jun. 12, 1989 (Year: 1989).*
(Continued)

*Primary Examiner* — George S Gray
(74) *Attorney, Agent, or Firm* — Benjamin Ford; Baker Botts L.L.P.

(57) ABSTRACT

A disclosed pulsed-power drilling system may include a controller that receives and analyzes feedback from downhole components reflecting changing conditions or performance measurements associated with a pulsed drilling operation to determine that an operating parameter of the drilling operation should be modified. The controller may output a control signal to cause an adjustment of a configurable downhole component, such as mechanical, electrical, or hydraulic component that affects the operating parameter, while the drill bit remains in the wellbore. The controller may adjust a segmented transformer of a pulse-generating
(Continued)

circuit, changing the number of primary winding switches that are fired, or the timing of the firing of the switches, to modify characteristics of the generated pulses. Adjusting a downhole component may affect the drilling rate, the drilling direction, the flow of drilling fluid, a pulse rise time, a pulse repetition rate, or a rate of penetration for the drilling operation.

27 Claims, 12 Drawing Sheets

(51) Int. Cl.
*E21B 44/00* (2006.01)
*E21B 21/06* (2006.01)
*E21B 47/12* (2012.01)

(52) U.S. Cl.
CPC ..... *E21B 21/065* (2013.01); *E21B 47/12* (2013.01); *E21B 49/00* (2013.01)

(58) Field of Classification Search
CPC .... E21B 49/005; E21B 21/065; E21B 47/138; E21B 47/006; E21B 41/0085
See application file for complete search history.

(56) References Cited

U.S. PATENT DOCUMENTS

| | | | | |
|---|---|---|---|---|
| 7,999,695 | B2 | 8/2011 | Rodney et al. | |
| 2005/0150688 | A1 | 7/2005 | MacGregor et al. | |
| 2007/0007039 | A1 | 1/2007 | Noel | |
| 2008/0025148 | A1 | 1/2008 | Camwell et al. | |
| 2008/0164031 | A1 | 7/2008 | Howell et al. | |
| 2009/0050371 | A1 | 2/2009 | Moeny | |
| 2009/0133929 | A1* | 5/2009 | Rodland | E21B 10/60 175/16 |
| 2010/0212962 | A1 | 8/2010 | Rosten et al. | |
| 2013/0032404 | A1 | 2/2013 | Donderici et al. | |
| 2014/0085099 | A1 | 3/2014 | Menezes et al. | |
| 2016/0017663 | A1* | 1/2016 | Moeny | E21B 17/003 175/327 |
| 2017/0204668 | A1* | 7/2017 | Lehr | E21B 7/04 |
| 2018/0148981 | A1 | 5/2018 | Moeny | |
| 2018/0209216 | A1 | 7/2018 | Gilbrech | |
| 2018/0209217 | A1 | 7/2018 | Moeny et al. | |
| 2018/0252097 | A1 | 9/2018 | Skinner et al. | |
| 2018/0313158 | A1* | 11/2018 | Gilbrech | E21C 37/18 |
| 2018/0347282 | A1 | 12/2018 | Moeny | |
| 2019/0040685 | A1 | 2/2019 | Moeny | |

FOREIGN PATENT DOCUMENTS

| | | |
|---|---|---|
| WO | 2014/008483 | 1/2014 |
| WO | 2014/100255 | 6/2014 |
| WO | 2014/105049 | 7/2014 |
| WO | 2014/123524 | 8/2014 |
| WO | 2015/069759 | 5/2015 |
| WO | 2017/030614 | 2/2017 |
| WO | 2017/069751 | 4/2017 |
| WO | 2017/069896 | 4/2017 |
| WO | 2017/074374 | 5/2017 |
| WO | 2017/146673 | 8/2017 |
| WO | 2018/071020 | 4/2018 |
| WO | 2018/136093 | 7/2018 |
| WO | 2018/186828 | 10/2018 |

OTHER PUBLICATIONS

International Search Report and Written Opinion of PCT Patent Application No. PCT/US2019/033977, dated Feb. 21, 2020,

* cited by examiner

DOWNHOLE RECONFIGURATION OF PULSED-POWER DRILLING SYSTEM COMPONENTS DURING PULSED DRILLING OPERATIONS

RELATED APPLICATIONS

This application is a Continuation Application of U.S. patent application Ser. No. 16/421,251 filed May 23, 2019.

TECHNICAL FIELD

The present disclosure relates generally to pulsed drilling operations and, more particularly, to systems and methods for downhole reconfiguration of pulsed-power drilling system components during pulsed drilling operations.

BACKGROUND

Pulsed-power drilling uses pulsed power technology to drill a wellbore in a rock formation. Pulsed power technology repeatedly applies a high electric potential across electrodes of a pulsed-power drill bit, which ultimately causes the surrounding rock to fracture. The fractured rock is carried away from the bit by drilling fluid and the bit advances downhole.

BRIEF DESCRIPTION OF THE DRAWINGS

For a more complete understanding of the present disclosure and its features and advantages, reference is now made to the following description, taken in conjunction with the accompanying drawings, in which:

FIGS. 3A to 3C illustrate three example pulse-generating (PG) circuits;

DETAILED DESCRIPTION

Figure 1:
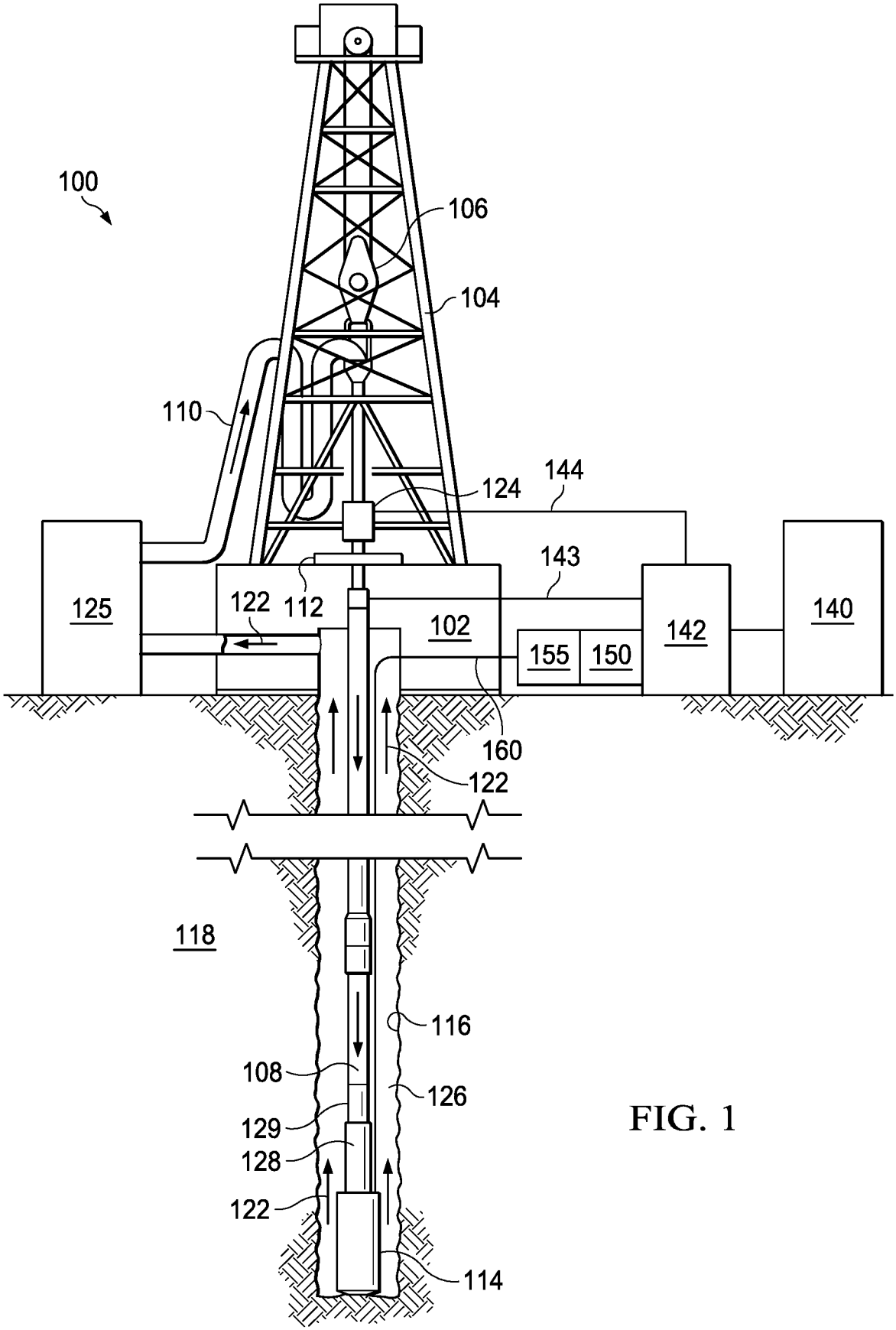
FIG. 1 is an elevation view of an exemplary pulsed-power drilling (PPD) system used in a wellbore environment.

Pulsed-power drilling may be used to form wellbores in subterranean rock formations for recovering hydrocarbons, such as oil and gas, from these formations. Electrocrushing drilling uses pulsed-power technology to fracture the rock formation by repeatedly delivering electrical arcs or high-energy shock waves to the rock formation. More specifically, a drill bit of a pulsed-power drilling (PPD) system is excited by a train of high-energy electrical pulses that produce high power discharges through the formation at the distal end of the drill bit. The discharges produced by the high-energy electrical pulses, in turn, fracture part of the formation proximate to the drill bit and produce electromagnetic and acoustic waves that carry further information about properties of the formation.

PPD systems have several defining parameters, the particular values of which may be determined during design of the systems with a goal of optimizing the rate of penetration (ROP) or other drilling performance factors. The parameter values may be determined for a particular assumed set of downhole conditions such as, for example, lithology or mud properties, and may affect how certain configurable downhole components (CDCs) of the PPD system are configured before they are placed downhole. The downhole conditions are typically not fully known prior to a particular pulsed drilling (PD) operation and may change over the course of the operation. Because of these unknowns and the potential for changing conditions, CDCs may be configured sub-optimally when placed downhole or may become less optimally configured during a drilling operation due to changing conditions.

As described herein, a component of a PPD system may be re-configured during PD operations. The system may be configured to provide at least two different configurations, or optimization points, that can be used during a PD operation without removing the drill bit or other downhole components in the drill string from the wellbore. Each configuration may be defined by a respective collection of operating parameters that is suitable for particular PD operations based, for example, on properties of the formation to be drilled or on drilling performance criteria for the PD operations. For example, systems and methods described herein may be used to adjust one or more CDCs for pulsed power drilling to effect a modification of a single operating parameter of a PD operation. In another example, systems and methods described herein may be used to adjust one or more CDCs for pulsed power drilling to cause a change from one predefined drilling mode to another predefined drilling mode by causing a modification of two or more operating parameters of a PD operation.

Techniques for downhole reconfiguration of a configurable component may use any of several methods and associated subsystems for making real-time adjustments to CDCs for pulsed power drilling to affect a drilling performance measurement or to modify an operating parameter of a PD operation. These methods and subsystems may include (i) determining that a modification should be made to one or more operating parameters of a PD operation (ii) adjusting at least one CDC of the PD operation to effect the modification of each of these operating parameters to at least one alternate value, (iii) initiating the adjustment of the CDCs, using any of a variety of types of control signals and communication methods, and (iv) downhole actuation to translate these control signals to cause the adjustment of the CDCs affecting the operating parameter values.

A controller for a PPD system may automatically determine that a modification should be made to an operating parameter of a PD operation. The controller may also initiate the adjustment of one or more CDCs to effect the desired modification. For example, a pulsed drilling controller (PDC) may receive and analyze feedback from various downhole and/or surface-based components reflecting changing conditions for a PD operation or a change in drilling performance measurements associated with the PD operation to determine whether to modify any of the current operating parameters of the PD operation. More specifically, it may be determined that a drilling speed, drilling direction, hole caliper or hole quality, drilling process energy efficiency, taxing of the tool componentry, or other parameter indicative of the operational goals of a PD operation and/or a type or property of mud, a bottom hole assembly (BHA) configuration (e.g., a position of a stabilizer or valve), a configuration of the drill bit (e.g., a position or configuration of an insulator or nozzle), a controllable characteristic of the electrical circuits and/or other components of a pulsed-power tool, and/or another operating parameter of the systems employed to meet the operational goals of the PD operation should be modified to optimize the PD operation in response to an observed or predicted change in conditions or a change in drilling performance measurements taken during the PD operation.

If it is determined that one or more of the current operating parameters should be modified, the PDC may output control signals to initiate the adjustment of the CDCs that directly or indirectly affect the operating parameters to be modified. Alternatively, one or both of determining that modifications should be made and initiating the adjustment of CDCs to effect the modifications may be performed by or under the direction of a person such as, for example, an engineer or equipment operator, in response to changing conditions for a PD operation or a change in drilling performance measurements associated with the PD operation. For example, an engineer or equipment operator may provide input or issue a command to a PDC indicating that an adjustment should be made to a CDC. In response, the PDC may output a control signal to cause the adjustment.

There are numerous ways in which a PPD system may cause the downhole reconfiguration of a configurable component during a PD operation. Thus, embodiments of the present disclosure and its advantages are best understood by referring to FIGS. 1 through 12, where like numbers are used to indicate like and corresponding parts.

FIG. 1 is an elevation view of an exemplary PPD system used to form a wellbore in a subterranean formation. Although FIG. 1 shows land-based equipment, downhole tools incorporating teachings of the present disclosure may be satisfactorily used with equipment located on offshore platforms, drill ships, semi-submersibles, and drilling barges (not expressly shown). Additionally, while wellbore 116 is shown as being a generally vertical wellbore, wellbore 116 may be any orientation including generally horizontal, multilateral, or directional.

PPD system 100 includes drilling platform 102 that supports derrick 104 having traveling block 106 for raising and lowering drill string 108. Drill string 108 may be raised and lowered using a draw-works, such as a machine on the rig including a large diameter spool (not shown) of wire rope. The draw-works may be driven by a power source, such as an electric motor (not shown), or hydraulically to spool-in the wire rope to raise the drill string. The draw-works may be able to spool-out the wire rope to lower the drill string under the force of gravity acting on the drill string within the wellbore. The draw-works may include a brake to control the lowering of the drill string. The draw-works may include a crown block which, together with traveling block 106, form a block and tackle with several windings of the wire rope between them for mechanical advantage. Sensors may be mounted on or proximate to the draw-works spool to measure the rotation, from which changes in the depth of the drill string may be calculated. Time may also be measured and, together with the calculations of changes in depth, may enable the calculation of instantaneous and average rates of penetration (ROP). PPD system 100 may also include pump 125, which circulates drilling fluid 122 (also called "mud") through a feed pipe to kelly 110, which in turn conveys drilling fluid 122 downhole through interior channels of drill string 108 and through one or more fluid flow ports in pulsed-power drill bit 114. Drilling fluid 122 circulates back to the surface via annulus 126 formed between drill string 108 and the sidewalls of wellbore 116. Fractured portions of the formation (also called "cuttings") are carried to the surface by drilling fluid 122 to remove those fractured portions from wellbore 116. Drilling fluid 122 and cuttings returning from downhole to the surface may flow over a shale shaker or another device that removes the cuttings from drilling fluid 122. The portion of drilling fluid 122 returned from downhole to the surface may be collected in surface tanks and may be tested by personnel or through automated fluid management systems, after which an adjustment to drilling fluid may be initiated. For example, a person or automated system may examine, and subsequently initiate an adjustment to, properties of drilling fluid 122 that may have changed as a result of processes in wellbore 116. Sensors may be employed at the surface, e.g., at the shale shaker or along the flow lines through which drilling fluid 122 is returned to the surface, to examine the properties of the cuttings and drilling fluid 122 returned to the surface. Gas entrained in drilling fluid 122 or cuttings may be captured and analyzed by personnel or the volume and/or other characteristics of the entrained gas may be directly measured by sensors at the surface.

Drilling fluid 122 may have rheological properties for removing cuttings from wellbore 116. Drilling fluid 122 may also have electrical properties conducive to particular PD operations. Drilling fluid 122 may be or include oil-based fluids or water-based fluids, depending upon the particular pulsed power drilling approach used. Drilling fluid 122 may be formulated to have high dielectric strength and a high dielectric constant, so as to direct electrical arcs into the formation rather than them being short circuited through drilling fluid 122.

PPD system 100 may include valve 124 at the surface. The opening and closing of valve 124 may be controlled to create pressure pulses, sometimes referred to as mud pulses, in drilling fluid 122 that convey commands or other information to various downhole components. The pressure pulses, or mud pulses, may be sensed by a sensor at the BHA, e.g., a pressure sensor ported to the flow path of drilling fluid 122 through the BHA tubular elements. The resulting sensor signals may inform or be translated (e.g., by a processor) into commands used in controlling a PD operation. The resulting sensor signals may be translated by various actuators into other types of control signals used to control a PD operation.

Valve 124 may be positioned anywhere along the flow path of drilling fluid 122 from mud pump 125 to kelly 110. In one example, valve 124 may be in-line with the flow path and may, when activated, cause or relieve a restriction in the flow path to create mud pulses. In another example, valve 124 may be positioned to vent or bypass a portion of drilling fluid 122 or to make a change to a bypass from the main flow path of drilling fluid 122 to kelly 110 and drill string 108 to create mud pulses. In this example, the portion of drilling fluid 122 vented using valve 124 may then be returned by other pipes or tubular elements to mud tanks on the surface or to an inlet of mud pump 125. Valve 124 may include a solenoid or other mechanism for activation and may be controlled using an electrical signal input or a digital command.

Valve 124 may include a rotor and stator within the path of drilling fluid 122 to create periodic brief interruptions or restrictions in the flow of drilling fluid 122 as the turbine vanes cross the openings between the stator vanes. The rotor speed may be modulated (e.g., via electrical or mechanical braking) using an electrical control system, thus changing the periodicity or frequency of the interruptions and corresponding perturbations or pulses within drilling fluid 122.

Pulsed-power drill bit 114 is attached to the distal end of drill string 108 and may be an electrocrushing drill bit or an electrohydraulic drill bit. Power may be supplied to drill bit 114 from components downhole, components at the surface and/or a combination of components downhole and at the surface. For example, generator 140 may generate electrical power and provide that power to power-conditioning unit 142. Power-conditioning unit 142 may then transmit electrical energy downhole via surface cable 143 and a subsurface cable (not expressly shown in FIG. 1) contained within drill string 108 or attached to the outer wall of drill string 108. A pulse-generating (PG) circuit within BHA 128 may receive the electrical energy from power-conditioning unit 142 and may generate high-energy electrical pulses to drive drill bit 114. The high-energy electrical pulses may discharge through the rock formation and/or drilling fluid 122 and may provide information about the properties of the formation and/or drilling fluid 122. The PG circuit within BHA 128 may be located near drill bit 114. The PG circuit may include a power source input, including two input terminals, and a first capacitor coupled between the input terminals. The pulse generating circuit may include a first inductor coupled between the input terminals with associated opening switch and a first capacitor coupled to the two ends of the inductor. The PG circuit may also include a switch, a transformer, and a second capacitor whose terminals are coupled to respective electrodes of drill bit 114. The switch may include a mechanical switch, a solid-state switch, a magnetic switch, a gas switch, or any other type of switch suitable to open and close the electrical path between the power source input and a first winding of the transformer. The transformer generates a current through a second winding when the switch is closed and current flows through first winding. The current through the second winding charges the second capacitor. As the voltage across the second capacitor increases, the voltage across the electrodes of the drill bit increases. As described below with reference to FIG. 6, the transformer may be a segmented primary transformer including multiple primary windings and a single secondary winding. In another example, the transformer may be a magnetic core transformer. The pulse generating circuit may also include a first inductor coupled between the input terminals with an associated opening switch and a second capacitor whose terminals are coupled to each end of the first inductor and to respective electrodes of drill bit 114. The first inductor may be an air core inductor or a magnetic core inductor and may generate the full voltage needed by the second capacitor for drilling. The inductor may be a segmented inductor including multiple windings with respective opening switches. Three example PG circuits are illustrated in FIGS. 3A through 3C, respectively.

The PG circuit within BHA 128 may be utilized to repeatedly apply a large electric potential across the electrodes of drill bit 114. For example, the applied electric potential may be in the range of 150 kv to 300 kv or higher. In this example, the lower bound on the applied electric potential may correspond to a lower bound on pulsed current of 500 amps. In another example, the lower bound on the applied electric potential may be 80 kv, with a lower bound on pulsed current of 500 amps In yet another example, the lower bound on the applied electric potential may be 60 kv, again with a lower bound on pulsed current of 500 amps. Each application of electric potential is referred to as a pulse. The high-energy electrical pulses generated by the PG circuit may be referred to as pulse drilling signals. When the electric potential across the electrodes of drill bit 114 is increased enough during a pulse to generate a sufficiently high electric field, an electrical arc forms through rock formation 118 at the distal end of wellbore 116. The arc temporarily forms an electrical coupling between the electrodes of drill bit 114, allowing electric current to flow through the arc inside a portion of the rock formation at the distal end of wellbore 116. The arc greatly increases the temperature and pressure of the portion of the rock formation through which the arc flows and the surrounding formation and materials. The temperature and pressure are sufficiently high to break the rock into small bits referred to as cuttings. This fractured rock is removed, typically by drilling fluid 122, which moves the fractured rock away from the electrodes and uphole. The terms "uphole" and "downhole" may be used to describe the location of various components of PPD system 100 relative to drill bit 114 or relative to the distal end of wellbore 116 shown in FIG. 1. For example, a first component described as uphole from a second component may be further away from drill bit 114 and/or the distal end of wellbore 116 than the second component. Similarly, a first component described as being downhole from a second component may be located closer to drill bit 114 and/or the distal end of wellbore 116 than the second component.

The electrical arc may also generate acoustic and/or electromagnetic waves that are transmitted within rock formation 118 and/or drilling fluid 122. Sensors placed within wellbore 116 and/or on the surface may record responses to high-energy electrical pulses, acoustic waves and/or electromagnetic waves. Sensor analysis system (SAS) 150 may, during PD operations, receive measurements representing the recorded responses and may analyze the measurements to determine characteristics of rock formation 118 or for other purposes. PPD system 100 may also include mud pulse valve 129 downhole. The opening and closing of mud pulse valve 129 may be controlled to create pressure pulses in drilling fluid 122 that convey information to various components on the surface. In one example, an optical fiber may be positioned inside a portion of wellbore 116 and a distributed acoustic sensing subsystem may sense the pressure pulses based on changes in strain on the optical fiber and translate them into electrical signals that are provided to SAS 150, Other types of pressure sensing mechanisms at the surface may detect the pressure pulses and translate them into electrical signals that are provided to SAS 150. Pulsed drilling controller (PDC) 155 may determine that a current operating parameter of a PD operation should be modified based on the analysis performed by SAS 150, and may output a control signal to adjust a CDC that directly or indirectly affects the operating parameter to be modified.

Wellbore 116, which penetrates various subterranean rock formations 118, is created as drill bit 114 repeatedly fractures the rock formation and drilling fluid 122 moves the fractured rock uphole. Wellbore 116 may be any hole formed in a subterranean formation or series of subterranean formations for the purpose of exploration or extraction of natural resources such as, for example, hydrocarbons, or for the purpose of injection of fluids such as, for example, water, wastewater, brine, or water mixed with other fluids. Additionally, wellbore 116 may be any hole formed in a subterranean formation or series of subterranean formations for the purpose of geothermal power generation.

Although pulsed-power drill bit 114 is described above as implementing electrocrushing drilling, pulsed-power drill bit 114 may also be used for electrohydraulic drilling. In electrohydraulic drilling, rather than generating an electrical arc within the rock, drill bit 114 applies a large electrical potential across the one or more electrodes to form an arc across the drilling fluid proximate to the distal end of wellbore 116. The high temperature of the arc vaporizes the portion of the drilling fluid immediately surrounding the arc, which in turn generates a high-energy shock wave in the remaining fluid. The electrodes of electrohydraulic drill bit may be oriented such that the shock wave generated by the arc is transmitted toward the distal end of wellbore 116. When the shock wave contacts and bounces off of the rock at the distal end of wellbore 116, the rock fractures. Accordingly, wellbore 116 may be formed in subterranean formation 118 using drill bit 114 that implements either electrocrushing or electrohydraulic drilling. The circuit topologies used for electrohydraulic drilling may be the same as, or similar to, those used for electrocrushing drilling with at least some components of the circuits having different values.

SAS 150 may be positioned at the surface for use with PPD system 100 as illustrated in FIG. 1, or at any other suitable location. Any suitable telemetry mechanism 160 may be used for communicating signals between downhole components and surface-based components. For example, telemetry mechanism 160 may be used for communicating signals from various acoustic, electrical or electromagnetic sensors at the surface or downhole to SAS 150 during a PD operation. Telemetry mechanism 160 may include an optical fiber that extends downhole in wellbore 116 and SAS 150 may be coupled to the optical fiber. The optical fiber may be enclosed within a cable, rope, line, or wire. More specifically, the optical fiber may be enclosed within a slickline, a wireline, coiled tubing, or another suitable conveyance for suspending a downhole tool in wellbore 116. The optical fiber may be charged by a laser to provide power to PDC 155, SAS 150, or sensors located within wellbore 116. More specifically, one or more input/output interfaces of SAS 150 may be coupled to the optical fiber for communication to and from acoustic, electrical or electromagnetic sensors positioned downhole. For example, the sensors may transmit measurements to SAS 150. Any suitable number of SASs 150, each of which may be coupled to an optical fiber located downhole, may be placed inside or adjacent to wellbore 116.

PDC 155 may be positioned at the surface for use with PPD system 100 as illustrated in FIG. 1, or at any other suitable location. Any suitable telemetry system may be used for exchanging information by communicating acoustic, electrical or electromagnetic signals to or from PDC 155 during a PD operation. More specifically, one or more input/output interfaces of PDC 155 may be configured for communication to or from various electrical, mechanical, or hydraulic components located downhole during a PD operation. For example, PDC 155 may be coupled to telemetry mechanism 160, which may include an optical fiber that extends downhole in wellbore 116.

A variety of types of telemetry systems may be suitable for use in communicating commands from the surface to downhole components of PPD system 100 ("downlinks") and for communicating data from downhole components of PPD system 100 or other BHA elements to the surface ("uplinks"). Telemetry mechanism 160 illustrated in FIG. 1 may represent uplinks and/or downlinks associated with any suitable telemetry system. In some example PPD systems 100, one type of telemetry system may be used for downlinks and another type of telemetry system may be used for uplinks. In some example PPD systems 100, a single type of telemetry may be used for both downlinks and uplinks. In some example PPD systems 100, telemetry may be provided in only one direction (e.g., for downlinks or uplinks, but not both). In some example PPD systems 100, one type of telemetry may be used for a portion of the travel path of the uplinks and/or downlinks, and another type of telemetry may be used for another portion of the travel path of the uplinks and/or downlinks, with suitable couplers being included at the interface between the two portions of the travel path. Suitable telemetry systems include the mud pulse telemetry systems described above, which may be used for uplinks and/or downlinks.

Acoustic telemetry may be employed for uplinks and/or downlinks. For example, piezo or other devices may be coupled to drill string 108 at or near one end to create acoustic signals that travel along drill string 108, and other piezo or other devices may be coupled to drill string 108 at or near the opposite end of drill string 108 to receive the acoustic signals. Repeaters may be employed along drill string 108 to receive and re-launch the acoustic signals.

Electromagnetic (EM) telemetry may be employed for uplinks and/or downlinks. EM telemetry systems may utilize a relatively low frequency (e.g., 1 to 100 Hz) signal created using an antenna subsystem with an insulative gap in the BHA to communicate an electromagnetic signal from a location downhole to the surface. Drill string 108 and its casing may serve as one conductor and the formation may serve as the other conductor. The EM signal may be sensed at the surface by measuring voltage and/or current between the drill string casing or other connected conductive elements at the surface and an electrode coupled to the formation. An EM signal may be communicated from the surface to downlink by applying a low frequency signal between the two surface contact points, and may be sensed downhole by measuring voltage and/or current across the insulative gap of the antenna sub.

Uplinks and downlinks may be provided by a wire conveyed between the surface and one or more downhole components. Suitable implementations of this approach include running a wireline down the center of or along the outside of drill string 108. A wired pipe approach may utilize wire that is integral with the drill pipe and inductive couplings between sections of drill pipe. This wired pipe approach may be used for uplinks and/or downlinks.

PDC 155 may determine whether or when modifications should be made to the operating parameters of a PD operation and may initiate the adjustment of CDCs that directly or indirectly affect any operating parameters that are to be modified without the need for those components to be removed from wellbore 116. For example, PDC 155 may initiate real-time adjustments to CDCs of a PPD system in response to changing conditions during a drilling operation. By making real-time adjustments, the number of times that all or a portion of drill string 108 is removed from wellbore 116 may be reduced and the ROP achieved during PD operations may be improved.

Figure 5:
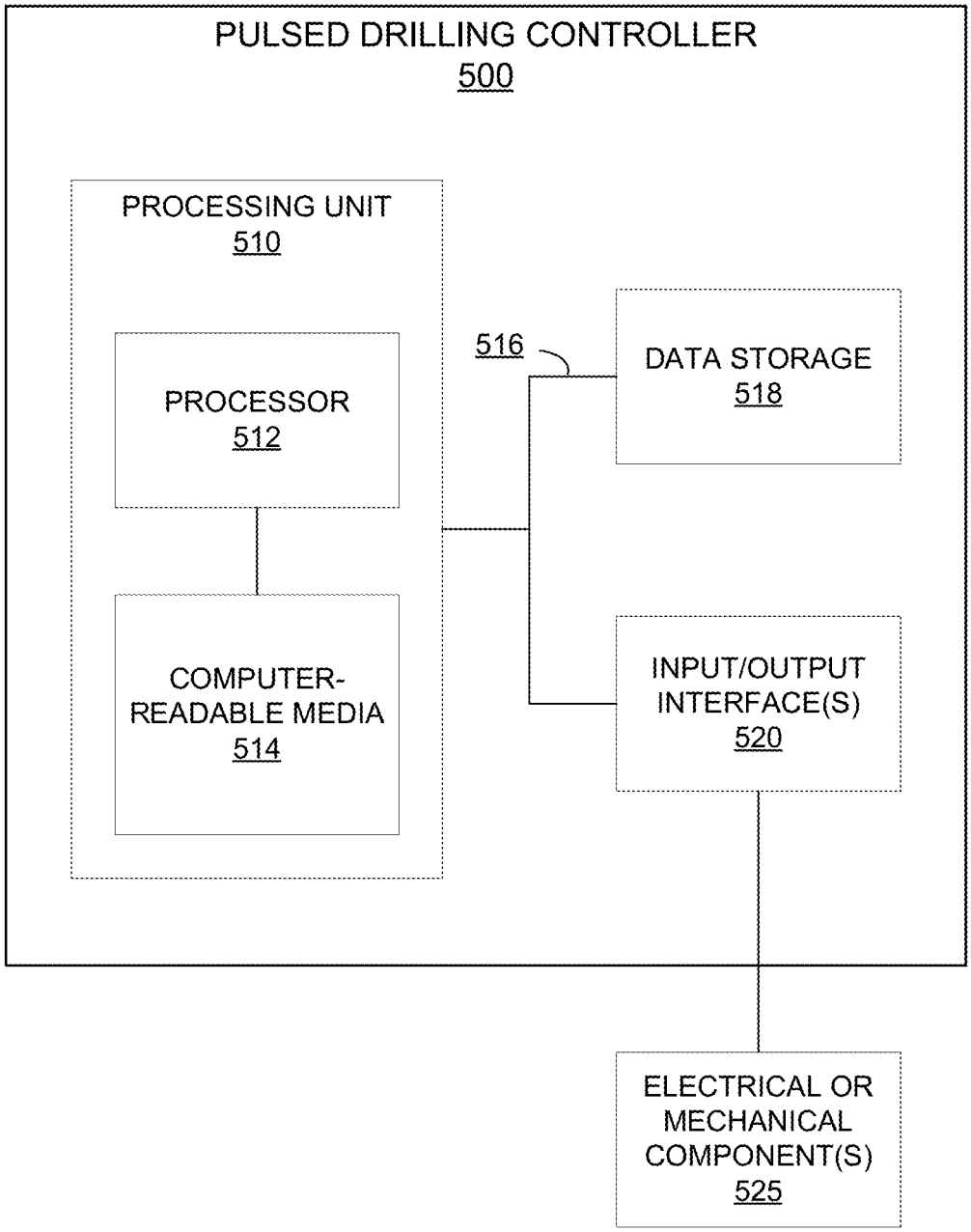
FIG. 5 is a block diagram illustrating an exemplary pulsed drilling controller.

PDC 155 may be coupled to, or otherwise in communication with, SAS 150. Alternatively, the functionality of SAS 150 may be integrated within PDC 155, with PDC 155 acting as a master controller for PD operations. An example PDC that includes an integrated SAS is illustrated in FIG. 5 and described below. Signal or informational inputs to PDC 155 may include measurements received from both downhole and surface sensors, or results of calculations made based on those measurements, indicating ROP, characteristics of cuttings, characteristics of drilling fluid 122 returning from downhole to the surface and/or entrained gas; downhole measurements of hole caliper or quality, vibration, or other wellbore characteristics; formation measurements; fluid pressure measurements; wellbore direction measurements; wellbore tortuosity or dogleg severity; and measurements of parameters within the pulsed-power tool itself, such as power draw, voltages, currents, frequencies, or wave forms measured within the tool at various sensing points, some of which may be associated with one or more particular electronic components.

The downhole operating environment is typically a high temperature environment, and the temperature may affect the performance, survival, and required maintenance cycles of the various electronic and other components of a pulsed-power tool. In addition, the operation of these components for pulsed power drilling may generate heat and may further raise the temperature of the environment and the components themselves. The temperature of a pulsed-power tool may be measured at one or more locations. Temperature measurements for a pulsed-power tool may be obtained using temperature sensors coupled to or proximate to particular electronic components of the pulsed-power tool. These temperature measurements may be useful for controlling operations in accordance with operating and/or survival specifications and intended operating points, for calculating component efficiency and/or for detecting incipient failure.

Inputs to PDC 155 may include modeled or otherwise calculated targets for one or more operating parameters of a PD operation. Inputs to PDC 155 may include user specified target values for one or more operating parameters of a PD operation.

Operating parameters of a PD operation may be modified by adjusting one or more CDCs. The adjustments may be made using electrical components, such as by activating or deactivating solid state switches, using electromechanical components, e.g., by controlling relays, or using purely mechanical components, such as by mechanically toggling a device from one state to a second or subsequent state.

Figure 2A:
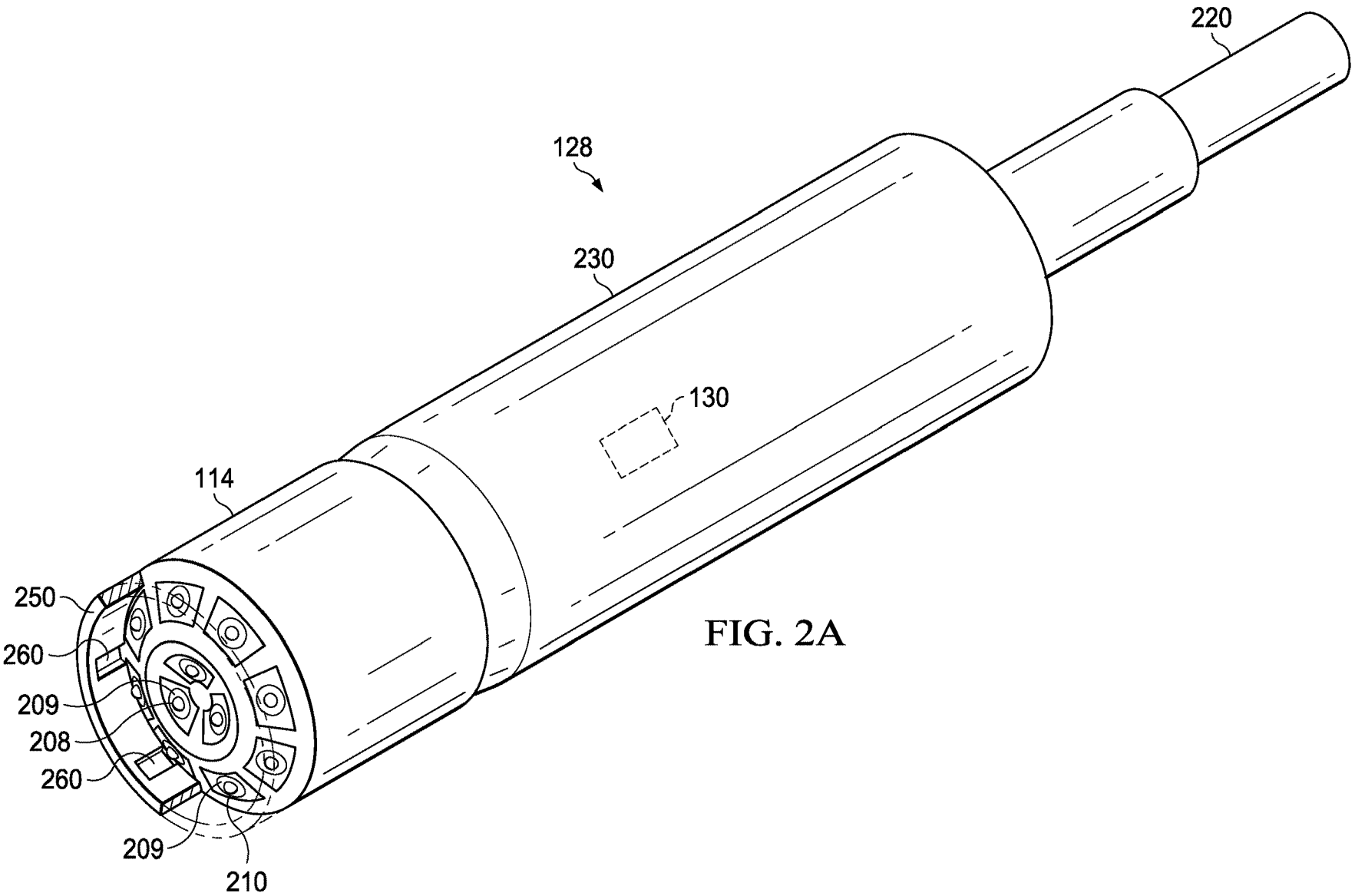
FIG. 2A is a perspective view of exemplary components of a bottom-hole assembly (BHA) for a PPD system.

FIG. 2A is a perspective view of exemplary components of a bottom-hole assembly for a PPD system. BHA 128 may include pulsed-power tool 230 and drill bit 114. For the purposes of the present disclosure, drill bit 114 may be integrated within BHA 128, or may be a separate component coupled to BHA 128.

Pulsed-power tool 230 may provide pulsed electrical energy to drill bit 114. Pulsed-power tool 230 receives electrical power from a power source via cable 220. For example, pulsed-power tool 230 may receive electrical power via cable 220 from a power source located on the surface as described above with reference to FIG. 1, or from a power source located downhole such as a generator powered by a mud turbine. Pulsed-power tool 230 may also receive electrical power via a combination of a power source located on the surface and a power source located downhole. Drill bit 114 may include one or more electrodes 208 and 210 and ground ring 250, shown in part in FIG. 2A. Ground ring 250 may function as an electrode. Pulsed-power tool 230 converts electrical power received from the power source into pulse drilling signals in the form of high-energy electrical pulses that are applied across electrodes 208 and/or 210 and ground ring 250 of drill bit 114. Pulsed-power tool 230 may include a PG circuit 130 as described above with reference to FIG. 1.

Although illustrated as a contiguous ring in FIG. 2A, ground ring 250 may be non-contiguous discrete electrodes and/or implemented in different shapes. Each of electrodes 208 and 210 may be positioned at a minimum distance from ground ring 250 of approximately 0.4 inches and at a maximum distance from ground ring 250 of approximately 6 inches. The distance between electrodes 208 or 210 and ground ring 250 may be based on the parameters of the PD operation and/or on the diameter of drill bit 114. For example, the distance between electrodes 208 or 210 and ground ring 250, at their closest spacing, may be at least 0.4 inches, at least 1 inch, at least 1.5 inches, or at least 2 inches.

Referring to FIG. 1 and FIG. 2A, drilling fluid 122 is typically circulated through PPD system 100 at a flow rate sufficient to remove fractured rock from the vicinity of drill bit 114. In addition, drilling fluid 122 may be under sufficient pressure at a location in wellbore 116, particularly a location near a hydrocarbon, gas, water, or other deposit, to prevent a blowout. Drilling fluid 122 may exit drill string 108 via openings 209 surrounding each of electrodes 208 and 210. The flow of drilling fluid 122 out of openings 209 allows electrodes 208 and 210 to be insulated by the drilling fluid. A solid insulator (not expressly shown) may surround electrodes 208 and 210 on drill bit 114. Drill bit 114 may also include one or more fluid flow ports 260 on the face of drill bit 114 through which drilling fluid 122 exits drill string 108, for example fluid flow ports 260 on ground ring 250. Fluid flow ports 260 may be simple holes, or they may be nozzles or other shaped features. Because fines are not typically generated during pulsed-power drilling, as opposed to mechanical drilling, drilling fluid 122 might not need to exit the drill bit with as high a pressure drop as the drilling fluid in mechanical drilling. As a result, nozzles and other features used to increase drilling fluid pressure drop and associated fluid velocity may not be needed on drill bit 114. However, nozzles or other features to increase the velocity of drilling fluid 122 or to direct drilling fluid may be included for some uses. Additionally, the shape of a solid insulator, if present, may be selected to enhance the flow of drilling fluid 122 around the components of drill bit 114.

If PPD system 100 experiences vaporization bubbles in drilling fluid 122 near drill bit 114, the vaporization bubbles may have deleterious effects. For instance, vaporization bubbles near electrodes 208 or 210 may impede formation of the arc in the rock. Drilling fluid 122 may be circulated at a flow rate also sufficient to remove vaporization bubbles from the vicinity of drill bit 114. Fluid flow ports 260 may permit the flow of drilling fluid 122 along with any fractured rock or vaporization bubbles away from electrodes 208 and 210 and uphole.

Figure 2B:
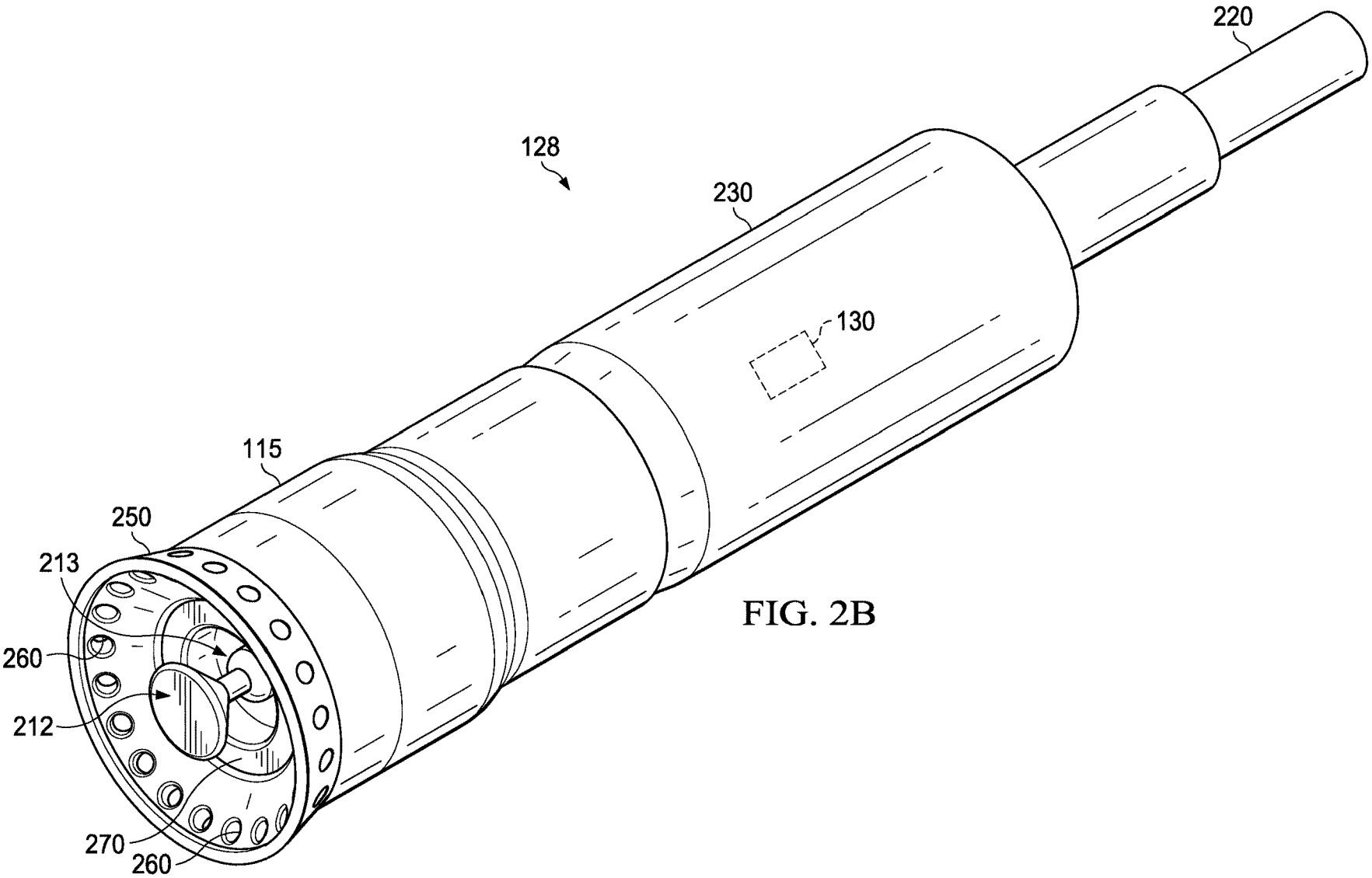
FIG. 2B is a perspective view of exemplary components of a bottom-hole assembly for a PPD system.

FIG. 2B is a perspective view of exemplary components of another bottom-hole assembly for a PPD system. BHA 128 may include pulsed-power tool 230 and drill bit 115. For the purposes of the present disclosure, drill bit 115 may be integrated within BHA 128, or may be a separate component that is coupled to BHA 128. BHA 128 and pulsed-power tool 230 may include features and functionalities similar to those discussed above with reference to FIG. 2A.

Drill bit 115 may include bit body 255, electrode 212, ground ring 250, and solid insulator 270. Electrode 212 may be placed approximately in the center of drill bit 115. Electrode 212 may be positioned at a minimum distance from ground ring 250 of approximately 0.4 inches and at a maximum distance from ground ring 250 of approximately 6 inches. The distance between electrode 212 and ground ring 250 may be based on the parameters of the PD operation and/or on the diameter of drill bit 115. For example, the distance between electrode 212 and ground ring 250, at their closest spacing, may be at least 0.4 inches, at least 1 inch, at least 1.5 inches, or at least 2 inches. The distance between electrode 212 and ground ring 250 may be generally symmetrical or may be asymmetrical such that the electric field surrounding the drill bit has a symmetrical or asymmetrical shape. The distance between electrode 212 and ground ring 250 allows drilling fluid 122 to flow between electrode 212 and ground ring 250 to remove vaporization bubbles from the drilling area. Electrode 212 may have any suitable diameter based on the PD operation, the distance between electrode 212 and ground ring 250, and/or the diameter of drill bit 115. For example, electrode 212 may have a diameter between approximately 2 and approximately 10 inches. Ground ring 250 may function as an electrode and provide a location on the drill bit where an electrical arc may initiate and/or terminate.

Drill bit 115 may include one or more fluid flow ports on the face of the drill bit through which drilling fluid exits the drill string 108. For example, ground ring 250 of drill bit 115 may include one or more fluid flow ports 260 such that drilling fluid 122 flows through fluid flow ports 260 carrying fractured rock and vaporization bubbles away from the drilling area. Fluid flow ports 260 may be simple holes, or they may be nozzles or other shaped features. Drilling fluid 122 is typically circulated through PPD system 100 at a flow rate sufficient to remove fractured rock from the vicinity of drill bit 115. In addition, drilling fluid 122 may be under sufficient pressure at a location in wellbore 116, particularly a location near a hydrocarbon, gas, water, or other deposit, to prevent a blowout. Drilling fluid 122 may exit drill string 108 via opening 213 surrounding electrode 212. The flow of drilling fluid 122 out of opening 213 allows electrode 212 to be insulated by the drilling fluid. Because fines are not typically generated during pulsed-power drilling, as opposed to mechanical drilling, drilling fluid 122 might not need to exit the drill bit with as high a pressure drop as is typical for the drilling fluid in mechanical drilling. As a result, nozzles and other features used to increase drilling fluid velocity may not be needed on drill bit 115. However, nozzles or other features to increase the velocity of drilling fluid 122 or to direct drilling fluid 122 may be included for some uses. Additionally, the shape of solid insulator 270 may be selected to enhance the flow of drilling fluid 122 around the components of drill bit 115.

As described above with reference to FIGS. 1, 2A, and 2B, when the electric potential across electrodes of a pulsed-power drill bit becomes sufficiently large, an electrical arc forms through the rock formation and/or drilling fluid that is near the electrodes. The arc provides a temporary electrical short between the electrodes, and thus allows electric current to flow through the arc inside a portion of the rock formation and/or drilling fluid at the distal end of the wellbore. The arc increases the temperature of the portion of the rock formation through which the arc flows and the surrounding formation and materials. The temperature is sufficiently high to vaporize any water or other fluids that might be proximate to the arc and may also vaporize part of the rock. The vaporization process creates a high-pressure gas and/or plasma which expands and, in turn, fractures the surrounding rock.

PPD systems and pulsed-power tools may utilize any suitable PG circuit topology to generate and apply high-energy electrical pulses across electrodes within the pulsed-power drill bit. Such PG circuit topologies may utilize electrical resonance to generate the high-energy electrical pulses required for pulsed-power drilling. The PG circuit 130 may be shaped and sized to fit within the circular cross-section of pulsed-power tool 230, which as described above with reference to FIGS. 2A and 2B, may form part of BHA 128. The PG circuit and its electronic components may be enclosed within an encapsulant, which may help maintain mechanical stability under shock and vibration. The encapsulant may be made of a thermally conductive material that helps transfer heat away from the PG circuit and its electronic components to protect the PG circuit and other components from damage due to the combination of self-generated heat and the heat of the ambient downhole environment. The downhole environment may include a wide range of temperatures. For example, the temperature within the wellbore may range from approximately 10 to approximately 300 degrees Centigrade.

The PPD systems described herein may generate multiple electrical arcs per second using a specified excitation current profile that causes a transient electrical arc to form an arc through the most conducting portion of the wellbore floor. The arc causes that portion of the distal end of the wellbore to disintegrate or fragment and be swept away by the flow of drilling fluid. As the most conductive portions of the wellbore floor are removed, subsequent electrical arcs may naturally seek the next most conductive portion. Therefore, obtaining measurements from which estimates of the excitation direction can be generated may provide information usable in determining characteristics of the formation. The measurements may include measurements of voltage or current over time for a single pulse and/or electrical arc or for multiple pulses and/or electrical arcs. A characterization of one or more wave forms associated with pulses or electrical arcs may be performed, for example, to determine frequency composition. A statistical analysis of multiple pulses, electrical arcs, or waveforms over a period of time may be performed, for example, to determine averages or standard deviations of any of the measurements or results of the calculations. The measurements, or calculations based on the measurements, may include or represent counts, rate of counts, an indication of regularity or irregularity, or an indication of trends and/or outlier instances of any of these measurements. The measurements and/or calculations based on the measurements may (e.g., in combination with the excitation direction and/or other characteristics of the formation) be indicative of a change in performance, efficiency, wear or incipient failure of the PPD system or components thereof that informs a decision about when and whether to make an adjustment to the operation of the pulsed power system.

Under certain circumstances, an operating parameter of a PD operation may be modified by making an adjustment to various elements of a drill bit, such as drill bit 114 illustrated in FIG. 2A or drill bit 115 illustrated in FIG. 2B. For example, a change in position or orientation of one of the electrodes of the drill bit or a change in position or orientation of a ground ring of the drill bit may be made in response to determining that a modification should be made to an operating parameter of a PD operation that is dependent on the electrical pulses or resulting electrical arcs generated in a PD operation, or that is dependent on any other controllable parameter associated with the PPD system. More specifically, the drill bit electrodes may be adjusted to shift on the radial axis of the drill bit axially (e.g., shifting them uphole or downhole in the wellbore) or circumferentially, or to change their orientations or profiles without changing their relative locations on the drill bit. Conductive elements or insulators may be inserted, retracted, or otherwise altered between electrodes. These actions may be accomplished by push or pull rods, hydraulics, or other linkage mechanisms, with or without biasing (e.g., springs), that are coupled to an actuation mechanism, such as those described herein. Similarly, the position or orientation of a ground ring or other grounding element of the drill bit may be adjusted uphole or downhole on the long axis of the drill bit, or radially.

Changes to the relative positions or orientations of the electrodes or grounding elements of the drill bit may result in changes in the paths of the electrical arcs produced at the drill bit, which may yield an improvement in a drilling performance measurement or another modification of an operating parameter for the PD operation. For example, particular changes in the relative positions or orientations of the electrodes or grounding elements during a PD operation may cause larger or smaller sized cuttings to be removed on each pulse, may affect the location at the distal end of the wellbore from which rock is removed, or may increase or decrease the amount of regrinding of the cuttings taking place at the distal end of the wellbore. In another example, particular changes in the relative positions or orientations of the electrodes or grounding elements may be used to modify the gauge of the wellbore during a PD operation when the PPD system is operating in an over gauge or under gauge condition. In yet another example, a drill bit made up of multiple lobes may include two or more separate drive circuits, e.g., one per lobe. In this example, the drive circuits may be independently adjusted to cause the respective pulsing characteristics of each lobe to be different, which may result in a modification of a drilling direction or other operating parameter during a PD operation.

The electrical pulses used for electrocrushing drilling may be generated using any of a variety of PG circuits including, but not limited to, circuits that include capacitive energy storage elements and circuits that include inductive energy storage elements. FIGS. 3A through 3C illustrate three non-limiting examples of PG circuits.

PG circuit 300, illustrated in FIG. 3A, is configured to store electrical energy in a primary capacitor $C_1$ (320) charged by an alternator (310) through an isolation switch $S_1$ (312). When the appropriate voltage has been reached on primary capacitor $C_1$ (320), that energy is switched by electrical switch $S_2$ (314) into a pulse transformer (350) to step up the voltage and charge an output capacitor $C_0$ (330). The rising voltage on output capacitor $C_0$ (330), which is coupled to a drill bit (340), creates the electrical arc that fractures the rock. In this example, PG circuit 300 uses capacitive energy storage.

PG circuit 302, illustrated in FIG. 3B, is configured to use an inductor for charging the primary capacitor $C_1$ (320), which in turn is switched to the transformer (350) to charge a secondary capacitor, shown as output capacitor $C_0$ (330). In this example, current runs from the alternator (310) through an isolation and opening switch $S_3$ (316) through an inductor $L_1$ (322) to store energy in the magnetic field. When that current is interrupted by opening switch $S_3$ (316), a large voltage is created across inductor $L_1$ (322). This example PG circuit 302 uses an opening switch $S_3$ (316) that first closes to connect inductor $L_1$ (322) to the alternator (310), or another power source, and then on command opens to interrupt that current flow, creating a voltage across inductor $L_1$ (322). In this example, opening switches such as $S_3$ (316) may need to be capable of high-voltage standoff. The voltage pulse from inductor $L_1$ (322) charges primary capacitor $C_1$ (320), which is then switched into the transformer (350) via switch $S_2$ (314). The rising voltage on output capacitor $C_0$ (330), which is coupled to a drill bit (340), creates the electrical arc that fractures the rock. In this example, PG circuit 302, inductor $L_1$ (322) and opening switch $S_3$ (316) may be used to step up the voltage output from the alternator (310). In this example, PG circuit 302 uses inductive energy storage.

PG circuit 304, illustrated in FIG. 3C, is configured to use the voltage output from an inductor $L_2$ (332) to directly charge a secondary capacitor, shown as output capacitor $C_0$ (330, eliminating the transformer. The rising voltage on output capacitor $C_0$ (330), which is coupled to a drill bit (340), creates the electrical arc that fractures the rock. The high voltage requirements for the corresponding opening switch, shown as $S_4$ (318), may be significant.

A PDC, such as PDC 155 may, based on results of an analysis by a SAS or other inputs, determine that a modification should be made to a current operating parameter of a PD operation. The SAS may be one element of a measurement system that records measurements usable to characterize a PD operation in real time.

Figure 4:
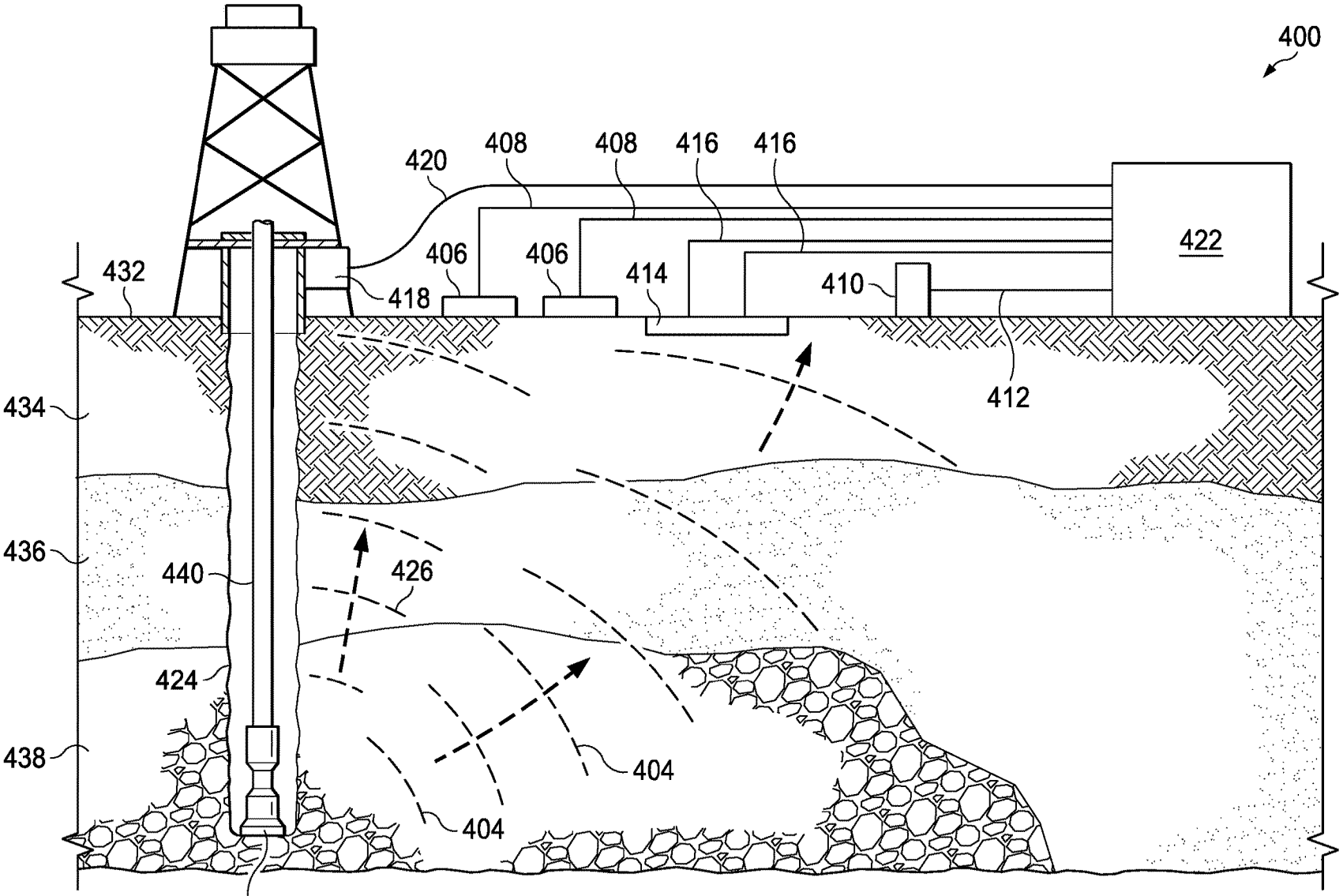
FIG. 4 is an elevation view of an exemplary measurement system associated with a PPD system.

FIG. 4 is an elevation view of an exemplary measurement system associated with a PPD system. Measurement system 400 may include SAS 422 that receives data from one or more of sensors 406, 410, 414 and 418 via one or more of interfaces 408, 412, 416, and 420. A PPD system may include pulsed-power drill bit 402 located at the distal end of wellbore 424. During PD operations, electromagnetic waves 404 and acoustic waves 426 may be created by pulses generated at drill bit 402. Electromagnetic waves 404 may propagate through one or more subterranean layers 438, 436, and 434 before reaching surface 432. Acoustic waves 426 may propagate uphole along wellbore 424 from drill bit 402 to surface 432 and travel through one or more subterranean layers 438, 436, 434. One or more of sensors 406, 410, 414 and 418 may be located in wellbore 424 and/or on surface 432. The sensors may be located a known distance from drill bit 402. The sensors may record responses to received signals including, but not limited to, pulse drilling signals in the form of high-energy electrical pulses, electromagnetic waves 404 and/or acoustic waves 426 created during PD operations. The sensors may send one or more measurements representing the recorded responses recorded to SAS 422, which analyzes the measurement data. One or more components of SAS 422 may be located on surface 432, in wellbore 424, and/or at a remote location. For example, SAS 422 may include a measurement processing subsystem in wellbore 424 that processes measurements provided by one or more of the sensors and transmits the results of the processing uphole to another component of SAS 422 for storage and/or further processing.

During PD operations, high-energy electrical pulses are applied to the electrodes of drill bit 402 to build up electric charge at the electrodes. The rock in the surrounding formation fractures when an electrical arc forms at drill bit 402. Electromagnetic waves 404 are created by the current associated with the electrical arc and/or the electric charge built up on the electrodes of drill bit 402. In addition, acoustic waves 426 are created by the electrical arc and subsequent fracturing of rock in the formation proximate to the drill bit.

The duration of an electrical arc created during a PD operation may be between approximately 0.1 μs and 100 μs. The duration of the electrical arc may be shorter than the repetition period of the high-energy electrical pulses that are applied to the electrodes of drill bit 402, which may repeat on the order of several to a few hundred hertz. Because the duration of the electrical arc is less than the repetition period of the pulses, electrical arcs that are generated at drill bit 402 may be represented by a series of impulses in which each impulse has a corresponding electromagnetic wave and acoustic wave. The time at which the impulse occurs may be used to measure, map, and/or image subterranean features. If the repetition period of the series of impulses is Ts, the Fourier transform of the impulses in the frequency domain consists of impulses occurring at multiples of a base frequency ($f_0$) equal to $2n\pi/Ts$. If drill bit 402 provides pulses at a constant frequency, a range of corresponding discrete frequencies (e.g., $f_0$, $2f_0$, $3f_0$) are generated in the frequency domain. The discrete frequencies may be used to measure, map, and/or image subterranean features.

Electromagnetic waves 404 and/or acoustic waves 426 originate from and/or in proximity to drill bit 402 at the distal end of wellbore 424 and propagate outward. For example, electromagnetic waves 404 and/or acoustic waves 426 may propagate through one or more of subterranean layers 438, 436, 434. A boundary defining the extent of an individual subterranean layer and/or defining a transition between two subterranean layers may be referred to as a bed boundary. Although FIG. 4 illustrates a formation having three layers, the subterranean formation may include any number of layers. Electromagnetic waves 404 and/or acoustic waves 426 created at and/or in proximity to drill bit 402 may propagate from layer 438 to the surface 432 via layers 434 and/or 436. Although electromagnetic waves 404 and acoustic waves 426 waves are illustrated in FIG. 4 as propagating in certain directions, electromagnetic waves 404 and acoustic waves 426 may propagate in any direction. In some cases, electromagnetic waves may be generated specifically for the purposes of formation analysis. For example, a high voltage capacitor may be coupled to a wire positioned around the perimeter of the pulse power system through a switch. When the switch is closed, an electromagnetic wave may be projected out ahead of drill bit 402 that will reflect off of the formation. Measurements made by sensors 406, 410, 414, and/or 418 may be analyzed by SAS 422 to evaluate the formation ahead of drill bit 402.

Sensors 406, 410, 414, and/or 418 record responses to received signals including, but not limited to, pulse drilling signals in the form of high-energy electrical pulses, electromagnetic waves and/or acoustic waves. Sensors 406, 410, 414, and 418 convert the recorded responses into measurements and send the measurements to SAS 422. The measurements may be digital representations of the recorded responses. Although three sensors are illustrated, measurement system 400 may include any number of sensors of any suitable type to detect, receive, and/or measure an electric and/or magnetic field. The sensors may include any type of sensor that records responses from electromagnetic and/or acoustic waves.

Sensor 406 may be communicatively coupled via interface 408 to SAS 422, sensor 410 may be communicatively coupled via interface 412 to SAS 422, and sensor 414 may be communicatively coupled via interface 416 to SAS 422. Each sensor may provide differential or single-ended measurement data to SAS 422 via an interface. For example, sensor 406 is illustrated with interface 408 having two sub-interfaces to transmit differential measurement data to SAS 422.

SAS 422 may receive measurements from one or more of sensors 406, 410, 414, and 418, and store the measurements as a function of pulse index and time or frequency. The pulse index may begin at one and be incremented each time a new pulse is generated at drill bit 402 during a PD operation. The measurements may be represented in the time domain or the frequency domain. In the time-domain, sensors 406, 410, 414, and 418 may measure electromagnetic waves by determining a voltage or current and may measure acoustic waves by determining a pressure or displacement. In the frequency domain, a sensor may measure the amplitude and phase by recording responses to the received signal, such as a steady state monochromatic signal, or by performing a Fourier transform of the signal, such as a wide band signal.

Acoustic waves 426 originate at or near drill bit 402 and propagate uphole along wellbore 424 to surface 432 during a PD operation. Sensor 418 may be located proximate to surface 432 and may record responses to the acoustic wave to provide measurements to SAS 422 via interface 420 such that SAS 422 may calculate the time at which the electrical arc is formed. Each acoustic wave may travel uphole to the surface along the casing of wellbore 424 and drill string 440 at a known velocity. For example, the acoustic wave travels at a velocity of approximately 5000 m/s if the casing and drill string 440 are formed of steel. Other materials suitable for PD operations with known acoustic propagation velocities may be used for the casing and drill string 440. For example, the acoustic propagation velocity is between 50 and 2000 m/s for rubber, on the order of 6000 m/s for titanium, and on the order of 4000 m/s for iron. The time of the formation of the electrical arc may be determined based on the known propagation velocity of the material used to form the casing and drill string 440 and the distance between surface 432 and drill bit 402. The distance between drill bit 402 and surface 432 may be determined by depth and position information generated by known downhole survey techniques for vertical drilling, directional drilling, multilateral drilling, and/or horizontal drilling.

Although FIG. 4 illustrates one acoustic sensor at the surface, any number of acoustic sensors suitable to measure, map, and/or image subterranean features may be positioned at one or more locations on the surface or elsewhere. For example, an array of acoustic sensors may be used within the wellbore. The acoustic sensors in the array may be positioned at different locations within the wellbore, and may be oriented in different directions to record responses to propagating acoustic waves. The array may provide information about the surrounding formation at various depths sufficient for SAS 422 to form a three-dimensional image of the surrounding subterranean features.

The equipment shown in FIG. 4 may be land-based or non-land based equipment or tools that incorporate teachings of the present disclosure. For example, some or all of the equipment may be located on offshore platforms, drill ships, semi-submersibles, or drilling barges (not expressly shown). Additionally, while the wellbore is shown as being a generally vertical wellbore, the wellbore may be any orientation including directional (in which the wellbore may include an angled section off of vertical, or one or more slants and/or curves) or generally horizontal. The wellbore may be part of a complex wellbore architecture, such as a multilateral well.

SAS 422 may process measurements received from sensors 406, 410, 414 and/or 418 to determine characteristics of the surrounding formation and to generate predictions about the formation layers downhole from drill bit 402. For example, the sensor analysis techniques described herein may be used to detect and analyze geologic features considered to be drilling challenges or hazards. Detection of such challenges or hazards facilitate the use of more efficient drilling strategies or drilling directions which may, in turn, reduce the cost of the drilling process while increasing the rate of penetration (ROP). The data collected by various acoustic, electric or electromagnetics sensors or sensor arrays may be used to optimize the drilling process. For example, a PDC, such as PDC 155 illustrated in FIG. 1, may use raw data collected by SAS 422 and/or the results of analyses performed by SAS 422 to determine whether or when the drilling speed, drilling direction, hole caliper or hole quality, drilling process energy efficiency, taxing of the tool componentry, or other parameter indicative of the operational goals of a PD operation and/or a type or property of mud, a BHA configuration (e.g., a position of a stabilizer or valve), a configuration of the drill bit (e.g., a position or configuration of an insulator or nozzle), a controllable characteristic of the electrical circuits and/or other components of the pulsed-power tool, and/or another operating parameter of the system employed to meet the operational goals of the PD operation should be modified to optimize the PD operation based on characteristics of the formation that are determined using the sensor data. In some cases, SAS 422 may be integrated within PDC 155, which acts as a master controller for pulsed drilling operations.

In PPD systems, the drill bit may be excited with a train of high-energy electrical pulses, which may or may not be uniform. The strength of the electric discharge will be different based on the properties of the formation over which the discharge occurs and the length of the discharge path. Reference electromagnetic and/or acoustic sensors positioned near the drill bit may record the strength of the waves produced by the PD operation near the electrical arc. Measurements representing the responses recorded by the reference sensors may be used to normalize the responses measured by the additional sensors. A SAS may use a forward model to invert the measured responses to the formation parameters.

The formation layer properties estimated using the techniques described herein based on electromagnetic sensor data may include, without limitation, electrical conductivity σ, dielectric permeability E and magnetic permeability p. The formation layer properties estimated based on the acoustic sensor data may include, without limitation, density d, shear velocity Vs, compressed velocity Vc, and Young's modulus. In addition to the formation properties, a position for each layer may be determined based on the electromagnetic and/or acoustic sensor data. The distributions and positions of layers within the formation may be determined based on the spatial distribution of these estimated properties.

The data collected by acoustic, electrical or electromagnetic sensors may be processed using any of a variety of methods to estimate the positions, electrical properties and acoustic properties of the formation layers ahead of the drilling tool. For example, migration or seismic processing techniques may be used that operate based on the concept of back propagation of the waves. A seismic profile from the surface may be used as an initial model for seismic processing. Velocities associated with layering may be computed though the use of a sonic tool in the BHA, e.g., through well-tying. The determined velocities may then be used as a-priori information for the geological model. The operation of an ultra-deep reading tool may be supplemented through the use of sensor data collection and analysis techniques based on the electromagnetic and acoustic waves produced by PD operations, as described herein. In one example, an ultra-deep reading tool may be used first to provide formation mapping around the BHA within approximately 100 feet (30.5 meters) of the BHA. Subsequently, the sensor data collection and analysis techniques described herein may be used to provide formation mapping within a range of approximately 100 to 500 feet (152.4 meters) of the BHA. The ultra-deep reading tool results for the 100 foot range may be used as an initial guess or a-priori information when determining the formation models for the 100 to 500 foot range. Model-based optimization techniques may also be used to estimate the distribution of the electrical and acoustic properties. Other methods with which to evaluate the layers ahead of the drilling tool use a statistical analysis of the measurements representing responses of electromagnetic and/or acoustic sensors or sensor arrays. Such statistical approaches may, for example, provide an estimate of the amount of variation that is expected to exist in the properties of the formation layers ahead of the tool relative to the properties of a formation layer through which the drilling tool is currently moving or through which the drilling tool previously moved.

An adjustment of a CDC to modify an operating parameter of a particular PD operation may be initiated in response to an evaluation of the actual or predicted formation layers ahead of the drilling tool (e.g., based on an analysis of sensor data or a formation layer predication) and/or on an analysis of the cuttings. The adjustment of the CDC to effect the operating parameter modification may be initiated by an operator at the surface such as, for example, a human, or a computer-based control system at the surface or downhole. For example, an engineer or equipment operator may provide input or issue a command to a PDC indicating that an adjustment should be made to a CDC. In response, the PDC may output a control signal to cause the adjustment. In one example, a control algorithm executing on PDC 155, with or without operator intermediation, may be used to initiate adjustments to particular CDCs during a PD operation to optimize a drilling plan without having to remove the components from the wellbore.

A person or processor may initiate adjustments to particular CDCs based on drilling performance measurements from sensors in the wellbore that inform the determination of the adjustments to be made. The sensors may be integrated in the pulsed-power tool or may be separate sensors within the BHA, such as within a measurement while drilling (MWD) system or a formation evaluation while drilling (FEWD) system. The drilling performance measurements may include, without limitation, directional measurements indicative of the wellbore's azimuth, inclination, and/or toolface orientation; wellbore caliper measurements; wellbore roughness or smoothness measurements; or measurements from formation evaluation sensors, including sensors for natural gamma rays, resistivity, neutron porosity, density, acoustic, or other parameters of interest. Sensors at the surface may be used to measure surface pressures, a rate of penetration of the drill string, and/or various parameters associated with the returns from downhole, including parameters associated with the entrained cuttings (e.g., a volumetric rate or the distribution of the size of the cuttings), with the quantity and composition of gas associated with the drilling fluid returns, and/or with properties of the returned drilling fluid (e.g., the composition of water, properties of chemicals, or physical fluid properties that may be reflective of a breakdown of the drilling fluid). Analyzing the cuttings or obtaining some of the measurements described herein may be performed by an operator (e.g., mud logger) and may be quantitative or qualitative, absolute or relative.

Drilling performance measurements may be indicative of the drilling performance goals for and/or performance results of a particular PD operation, and may be affected, directly or indirectly, by changes to a CDC. Making changes to CDCs may result in changes to, and may be reflected in changes measurements associated with, the average rate of penetration (ROP) for the wellbore; the ability to penetrate, and the ROP of, particular formations encountered while drilling the wellbore; the gauge of the wellbore; the quality (e.g., roughness or smoothness) of the wellbore surface; the size, size distribution, or other properties of the wellbore cuttings; properties or changes in properties of the drilling fluid including, without limitation, a quantity or composition of gas evolving from the drilling fluid; and/or the direction, directional tendency, or directional controllability of the wellbore.

FIG. 5 is a block diagram illustrating an exemplary PDC. In this example, the functionality of PDC 155 and SAS 150 illustrated in FIG. 1 may be integrated within PDC 500, which acts as a master controller for PD operations. PDC 500 may be positioned at the surface for use with PPD system 100, or at any other suitable location. PDC 500 may be configured to determine formation characteristics by analyzing sensor responses recorded during a PD operation, characteristics of cuttings, and/or any other suitable inputs to such an analysis including, but not limited to, those described herein. PDC 500 may also be configured to determine the ROP or other drilling performance measurements associated with a PD operation.

PDC 500 may be configured to determine whether or when the drilling speed, drilling direction, hole caliper or hole quality, drilling process energy efficiency, taxing of the tool componentry, or other parameter indicative of the operational goals of a PD operation and/or a type or property of mud, a BHA configuration (e.g., a position of a stabilizer or valve), a configuration of the drill bit (e.g., a position or configuration of an insulator or nozzle), a controllable characteristic of the electrical circuits and/or other components of the pulsed power tool, and/or another operating parameter of the systems employed to meet the operational goals of the PD operation, should be modified to optimize the PD operation. In response to a determination that an operating parameter of the PD operation should be modified, PDC 500 may be configured to cause an adjustment of a CDC of a PPD system while the drill bit remains downhole in the wellbore (e.g., without removing the component to be adjusted from the wellbore) to effect the desired operating parameter modification.

In the illustrated example, PDC 500 includes processing unit 510 coupled to one or more input/output interfaces 520 and data storage 518 over an interconnect 516. Interconnect 516 may be implemented using any suitable computing system interconnect mechanism or protocol.

Processing unit 510 may be configured to determine characteristics of a formation ahead of the drilling tool based, at least in part, on inputs received by input/output interfaces 520, some of which may include measurements representing responses recorded by various sensors within the wellbore, such as wellbore 116 illustrated in FIG. 1, such as voltages, currents, ratios of voltages to current, electric field strengths or magnetic field strengths. For example, processing unit 510 may be configured to perform one or more inversions based on simulation models that relate the electromagnetic properties of the formation to electromagnetic data collected by downhole sensors and/or relate the acoustic properties of the formation to acoustic data collected by downhole sensors. Processing unit 510 may be configured to determine the ROP or other drilling performance measurements associated with a PD operation based on feedback received from various CDCs, or other factors. PDC 500 may also be configured to determine that an operating parameter of the PD operation should be modified and to cause an adjustment of a CDC of a PPD system to effect the desired operating parameter modification.

Processing unit 510 may include processor 512 that is any system, device, or apparatus configured to interpret and/or execute program instructions and/or process data associated with PDC 500. Processor 512 may be, without limitation, a microprocessor, microcontroller, digital signal processor (DSP), application specific integrated circuit (ASIC), or any other digital or analog circuitry configured to interpret and/or execute program instructions and/or process data. In some cases, processor 512 may interpret and/or execute program instructions and/or process data stored in one or more computer-readable media 514 included in processing unit 510 to perform any of the methods described herein.

Computer-readable media 514 may be communicatively coupled to processor 512 and may include any system, device, or apparatus configured to retain program instructions and/or data for a period of time (e.g., computer-readable media). Computer-readable media 514 may include random access memory (RAM), read-only memory (ROM), solid state memory, electrically erasable programmable read-only memory (EEPROM), disk-based memory, a PCMCIA card, flash memory, magnetic storage, opto-magnetic storage, or any suitable selection and/or array of volatile or non-volatile memory that retains data after power to processing unit 510 is turned off. For example, computer-readable media 514 may include instructions for determining one or more characteristics of formation 118 based on signals received from various acoustic, electrical or electromagnetic sensors by input/output interfaces 520, logging data, or characteristics of cuttings; for determining the ROP or other drilling performance measurements associated with a PD operation; for determining that an operating parameter of the PD operation should be modified to optimize the PD operation based on current or changing conditions or drilling performance measurements; and for causing an adjustment of one or more downhole electrical or mechanical components 525 of the PPD system to effect the desired operating parameter modification.

Computer-readable media 514 may include instructions for implementing one or more control algorithms to analyze input signals received from other components of the PPD system, logging data, sensor responses, drilling performance measurements, and/or other inputs and to generate output signals that can be used as control signals to initiate appropriate adjustments of CDCs in order to modify one or more operating parameter of the PD operation. Computer-readable media 514 may include instructions for implementing different drilling modes, each of which defines a respective collection of operational goals and/or operating parameters of a PPD system in support of particular operational goals, and for determining whether and when to initiate a change to the drilling mode in response to changing conditions and/or drilling performance measurements. For example, each drilling mode may define one or more of a pulse generation mode, a drilling rate (e.g., a rate of penetration), an arc path of pulses between and amongst electrodes, a volumetric flow rate to be input to or bypassed from the drill bit via drill string valves, a drilling fluid velocity or directionality at the drill bit, a distribution of the flow of the drilling fluid at the drill bit, a rise time of an output pulse, a voltage or other electrical parameter associated with an output pulse, a pulse repetition rate, a hole caliper, a hole quality, a drilling process energy efficiency, a taxing of the tool componentry, or other parameter indicative of the operational goals for a PD operation and/or a desired characteristic of the cuttings, returned drilling fluid, and/or entrained gas.

Input/output interfaces 520 may be coupled to an optical fiber, such as an optical fiber element of telemetry mechanism 160 illustrated in FIG. 1, over which it may send and receive signals. Signals received by input/output interfaces 520 may include measurements representing responses recorded by various sensors at the surface or downhole during a PD operation. For example, signals received by input/output interfaces 520 may include measurements representing responses recorded by various acoustic, electrical or electromagnetic sensors. These measurements may include, without limitation, measurements of voltage, current, electric field strength, or magnetic field strength. These and other inputs may be received using communication interfaces or telemetry mechanisms other than an optical fiber including, but not limited to, the mechanisms for receiving acoustic, electric or electromagnetics signals illustrated in FIG. 4 and described above, and various mechanical telemetry methods.

The control signals generated by PDC 500 may be communicated to one or more electrical or mechanical components 525 located downhole via input/output interfaces 520 using any suitable communication protocol interfaces or telemetry mechanisms. For example, a control signal may be sent electrically over a power cable (e.g., over surface cable 143 illustrated in FIG. 1 and a sub-surface cable, or over cable 220 illustrated in FIG. 2A or 2B) or over a separate control cable, via an optical fiber, a wireline or a wired pipe, or via acoustic, mud pulse, or electromagnetic telemetry. In some cases, an electrical or mechanical control signal may be communicated directly to a configurable electrical or mechanical component downhole that is to be adjusted. In other cases, when the control signal does not convey actuation energy, the control signal may be communicated to an intermediate downhole component that receives the control signal and translates it to initiate the adjustment of the targeted CDC. In one example, the intermediate downhole component may engage a power supply for the actuation, such as a battery, a generator power, or power received from the surface over a cable that is switched in, in a controlled manner, to a relay or solid state switch). In another example, the intermediate downhole component may include a downhole electrical actuator or a downhole mechanical actuator operable to cause the adjustment of the targeted CDC. In one example, the intermediate downhole component may be a pulse generation controller (PGC) associated with a segmented primary transformer, and the control signal may indicate a particular pattern or timing to be used for firing the switches associated with each segment of the transformer to effect a modification of an operating parameter of a PD operation.

Where a control signal output by PDC 500 for initiating the state change of a targeted CDC does not directly cause the desired adjustment of the targeted component, an actuator may be used to translate the control signal to a second control signal that causes the adjustment of the targeted component. For example, various mechanisms for converting electrical energy to mechanical force and displacement such as, for example, a solenoid, a hydraulic pump and associated control valves, or other actuator systems and associated linkages, may be used to translate a control signal generated at the surface to cause an adjustment of a targeted CDC.

In one example, PDC 500 may communicate a control signal to a CDC using mud pulse telemetry. In this example, a valve may be opened at the surface to create a pressure wave perturbation in the drilling fluid, or to vent or add pressure at the surface, which may be detected downhole. Measurements of the pressure taken downhole may be converted into amplitude-modulated or frequency-modulated patterns of mud pulses that carry information. For example, a particular pattern of mud pulses may indicate an adjustment to be made to a CDC to modify an operating parameter of a PD operation or may indicate a change to a different drilling mode that requires the adjustment of multiple CDCs to affect the modification of one or more operating parameters of the PD operation. Other suitable telemetry systems include, but are not limited to, the weight-set and pressure set methods described below.

In one example, PDC 500 may communicate a command or control signal to a CDC using a weight-set method or using a weight together with pressure set method. A weight-set method may be initiated by a person (e.g., human driller on the rig floor) or by a computer controlled auto-driller signaling that the draw-works should "slack-off." The command may initiate a reduction in the support by the draw-works of the weight of the drill string, resulting in a transmission of reduced tension in the hanging portion of the drill string through the neutral point along the drill string within the wellbore, and increasing the compression in the lower portion of the drill string. This may ultimately result in an increase in the weight of the drill string borne by the bit (which may be referred to as the "weight on bit" or "WOB"). This increased WOB may cause a BHA element that has axial compliance responsive to weight (e.g., a telescoping feature utilizing a spring-loaded mandrel within a housing) to mechanically respond to the increased WOB. A pressure set method may include a person (e.g., human driller on the rig floor) or controller initiating an increase or decrease in the flow rate, which may cause a change in the pressure drop over a restriction in a BHA element that is itself coupled to a spring-loaded mandrel within a housing. The two systems and methods may be coupled and used together to enable a more reliable control signal from the surface. For example, they may be used individually or collectively to raise the flow rate above a nominal rate, thus inducing a BHA pressure drop, and then, during the period of higher flow and higher pressure drop, slacking off to increase the WOB, resulting in a mechanical change of state for a CDC. A mechanical change of state may include a movement of a mandrel relative to a housing, which may be detected using strain gauges, various toggle mechanisms (e.g., a spring or spring-loaded toggle, or a double pole double throw toggle mechanism), linear variable differential transducer (LVDT) position sensors, or other mechanisms.

A weight-set mechanism may result in a pressure drop over an orifice of a tubular element through which drilling fluid flows, causing a section of a barrel cam in the drill string to compress against a spring, move axially. This may result in an incremental rotation of the barrel cam versus the housing in which it resides. The barrel cam may be configured to include two or more mechanical position states, which can be mechanically coupled (e.g., using mechanical linkages) to respective valves or other mechanical features of the PPD system to cause an adjustment of a CDC or to adjust respective electrical components that can be mechanically adjusted to change their electrical characteristics. Alternatively, a weight-set mechanism may mechanically cause a state change in a barrel cam that can be detected with sensors (e.g., strain gauges, toggle mechanisms, LVDT position sensors, or other mechanisms) and used to initiate an adjustment of a targeted CDC and a corresponding modification of an operating parameter of a PD operation.

A control signal may be represented by an individual weight-set event or by a sequence of weight-set events that change the flow of the drilling fluid in the PPD system by cycling it up or down with a particular timing. Under certain circumstances, when using flow cycling or level setting, which may optionally be used in conjunction with setting the weight within a certain range, the associated downhole pressure drop through an orifice may shift a sleeve or toggle a barrel cam to provide a strong axial or rotational step in a shaft, tubular element, or linkage with respect to its housing. A weight-set method may be used, for example, to latch or unlatch a feature of a CDC, or to contract or telescope a portion of a tubular element, responsive to change in the weight on the drill bit.

In one example, PDC 500 may communicate a control signal to a CDC using a ball-drop method to cause a shift in a CDC, such as to open or close a valve, or to otherwise control the flow path of drilling fluid 122 illustrated in FIG. 1 (e.g., to bypass a particular path or to direct the flow toward a particular path). In this example, when a ball is dropped or pumped through a tubular element, it may come in contact with a CDC. The ball may be sized to become lodged in a targeted portion of the CDC resulting in an adjustment that modifies an operating parameter of the PD operation. For example, the ball may block an orifice of a tubular element through which drilling fluid 122 flows such that when the fluid pressure is turned up and the flow of drilling fluid 122 is turned on, the flow may be forced to push down on the ball, causing a mechanical adjustment to the CDC. This mechanism may be applied multiple times where a ball catcher downhole stores the balls. However, if the balls are not dissolving balls, there may be a finite number of times the mechanism can be applied based on the storage capacity of the ball catcher. The presence or absence of balls, or the number of balls, may be detected using any suitable sensor, and the sensor reading may be converted to an electrical control signal within the PPD system.

In one example, a flow characteristic of drilling fluid 122 at drill bit 114 may be adjusted to modify the rate or manner with which cuttings or bubbles at drill bit 114 are cleared or for other purposes. In this example, a valve associated with drill bit 114 may be opened or closed to engage or disengage, or to switch a flow path, affecting the overall flow area for drilling fluid 122, the velocity of the drilling fluid flow, the distribution of drilling fluid 122, and/or the direction of flow. Characteristics of a nozzle on a tubular element through which drilling fluid 122 flows may similarly be adjusted, e.g., by changing the position of a tapered core or orifice of the nozzle. A valve associated with a port on the drill string 108 above drill bit 114 may be used to bypass or stop the bypass of drilling fluid 122 from drill bit 114, or to change the volumetric flow rate through drill bit 114. By controlling the valve, the flow of drilling fluid 122 going through drill bit 114 and the velocity of the flow, may be adjusted. For example, in order to allow more drilling fluid 122 to flow through a downhole turbine to power an alternator of a pulse power system, but not have that same volumetric flow rate through drill bit 114 (e.g., to reduce flow induced erosion of components of drill bit 114), the full volumetric flow of drilling fluid 122 may pass through the turbine, but then be partially bypassed to the annulus at a point downstream of the turbine but still above drill bit 114. An adjustable bypass valve placed downhole below the turbine may support multiple different settings, allowing a full bypass, a partial bypass, or no bypass around drill bit 114. Adjusting the bypass valve so that drilling fluid 122 partially bypasses drill bit 114 may result in a higher volumetric flow of drilling fluid 122 and the generation of more electricity than is the case with no bypass around drill bit 114. However, with the appropriate bypassing of the increased flow, the erosion of drill bit 114 and any washing out of the distal end of the wellbore, which might disrupt the work of drill bit 114, may be avoided.

In one example, a PDC, such as PDC 155 illustrated in FIG. 1 or PDC 500 illustrated in FIG. 5, may communicate a control signal to a CDC to adjust the flow of drilling fluid through the center of the drill string. The control signal may cause a valve in a tubular element through which drilling fluid 122 flows to be turned on, causing an increase in the flow of drilling fluid 122 through a first flow channel within the drill string 108, or off, causing a decrease in flow in the first channel and a corresponding increase in the flow of drilling fluid 122 in a second channel. The channels may be concentric. For example, drilling fluid 122 in the first channel may exit drill bit 114 through a hole in the center of a center electrode of drill bit 114, and drilling fluid 122 in the second channel may exit drill bit 114 through one or more holes, or an annular ring, radially displaced from the center of drill bit 114. The ability to toggle the state of the valve to allow more drilling fluid 122 to flow through the center of drill bit 114 from time to time may prevent the build-up of rock cuttings at the distal end of the hole which may impede drilling.

A control signal communicated by the PDC may cause two or more separate components (e.g., capacitors, inductors, transformers, or resistors) of a single drive circuit to be toggled in or out, or an adjusting mechanism (e.g., a solid state switch, a relay, or a purely mechanical switch) may disengage a circuit path conductor and/or engage another.

Data storage 518 may provide and/or store data and instructions used by processor 512 to perform any of the methods described herein for collecting and analyzing data from acoustic, electrical or electromagnetic sensors, logging data, or cuttings, for determining whether or when an operating parameter of a PD operation should be modified, and/or for causing an adjustment of a CDC to effect such a modification. In particular, data storage 518 may store data that may be loaded into computer-readable media 514 during operation of PDC 500. Data storage 518 may be implemented in any suitable manner, such as by functions, instructions, logic, or code, and may be stored in, for example, a relational database, file, application programming interface, library, shared library, record, data structure, service, software-as-service, or any other suitable mechanism. Data storage 518 may store and/or specify any suitable parameters that may be used to perform the described methods. For example, data storage 518 may store logging data (including, but not limited to, measurements representing responses recorded by various acoustic, electrical or electromagnetic sensors during one or more PD operations), characteristics of analyzed cuttings, drilling performance measurement data, and/or feedback returned from various CDCs of the PPD system. Data storage 518 may provide information used to direct components of PDC 500 to analyze the data stored in data storage 518 to determine characteristics of a formation, such as formation 118 as shown in FIG. 1, to determine whether or when an operating parameter of a PD operation should be modified, and/or to cause an adjustment of a CDC to effect such a modification. Information stored in data storage 518 may also include one or more models generated or accessed by processing unit 510. For example, data storage 518 may store a model used in an inversion process.

PDC 500 may use measurements representing responses recorded by various acoustic, electrical or electromagnetic sensors to determine formation characteristics ahead of (e.g., downhole from) the drill bit using reference sensor responses recorded during the PD operation to normalize other sensor responses. The analysis may include one or more inversions. In another example, the PDC 500 may be configured to determine dispersion characteristics of the pulse drilling signals with respect to a borehole wave-propagation mode, such as a Stoneley or flexural wave mode. The mode may be dependent on the frequency of the waves produced by the PD operations. A dispersion correction based on the generated dispersion characteristics may be used in determining a characteristic of the formation ahead of the drill bit.

The elements shown in FIG. 5 are exemplary only and PDC 500 may include fewer or additional elements. Modifications, additions, or omissions may be made to PDC 500 without departing from the scope of the present disclosure. For example, PDC 500 illustrates one particular configuration of components, but any suitable configuration of components may be used. In one example, PDC 500 may include a Distributed acoustic sensing (DAS) subsystem. In this example, with an optical fiber positioned inside a portion of wellbore 116 (e.g., as an element of telemetry mechanism 160 illustrated in FIG. 1), the DAS subsystem may determine characteristics associated with formation 118 based on changes in strain caused by acoustic waves. The DAS subsystem may be configured to transmit optical pulses into the optical fiber, and to receive and analyze reflections of the optical pulse to detect changes in strain caused by acoustic waves.

Components of PDC 500 may be implemented either as physical or logical components. Furthermore, functionality associated with components of PDC 500 may be implemented with special and/or general purpose circuits or components. Components of PDC 500 may also be implemented by computer program instructions. Where a PDC and a SAS are implemented as two separate systems, each of these systems may include respective instances of the elements illustrated in FIG. 5. For example, each system may include a processing unit, a processor, computer-readable media storing respective computer program instructions to perform any of the methods described herein for the particular system, data storage, and one or more input/output interfaces for communicating with electrical or mechanical components.

The state of an electrical component in a pulse power system may be toggled using any of the control signaling or adjusting mechanisms described herein. For example, a control signal communicated downhole may cause the position of a transformer or inductor core within the windings of a transformer to change such that the core characteristics seen by the fields within the windings are modified (e.g., via different core materials, different dimensions, or other factors). This may result in a change in the inductance of the transformer and, therefore, a change in the rise time or a change in another characteristic of the pulses created by the PG circuit within the BHA (e.g., within BHA 128). Similarly, a shielding component in the pulse power system may be repositioned or otherwise adjusted to modify the component characteristics. Where a pulse power system, includes a magnetic core transformer, the PDC may communicate a control signal to reposition the magnetic core, e.g., using a mechanical actuator, and, in doing so, change the output characteristics of the pulses generated by the pulse power system.

Figure 6:
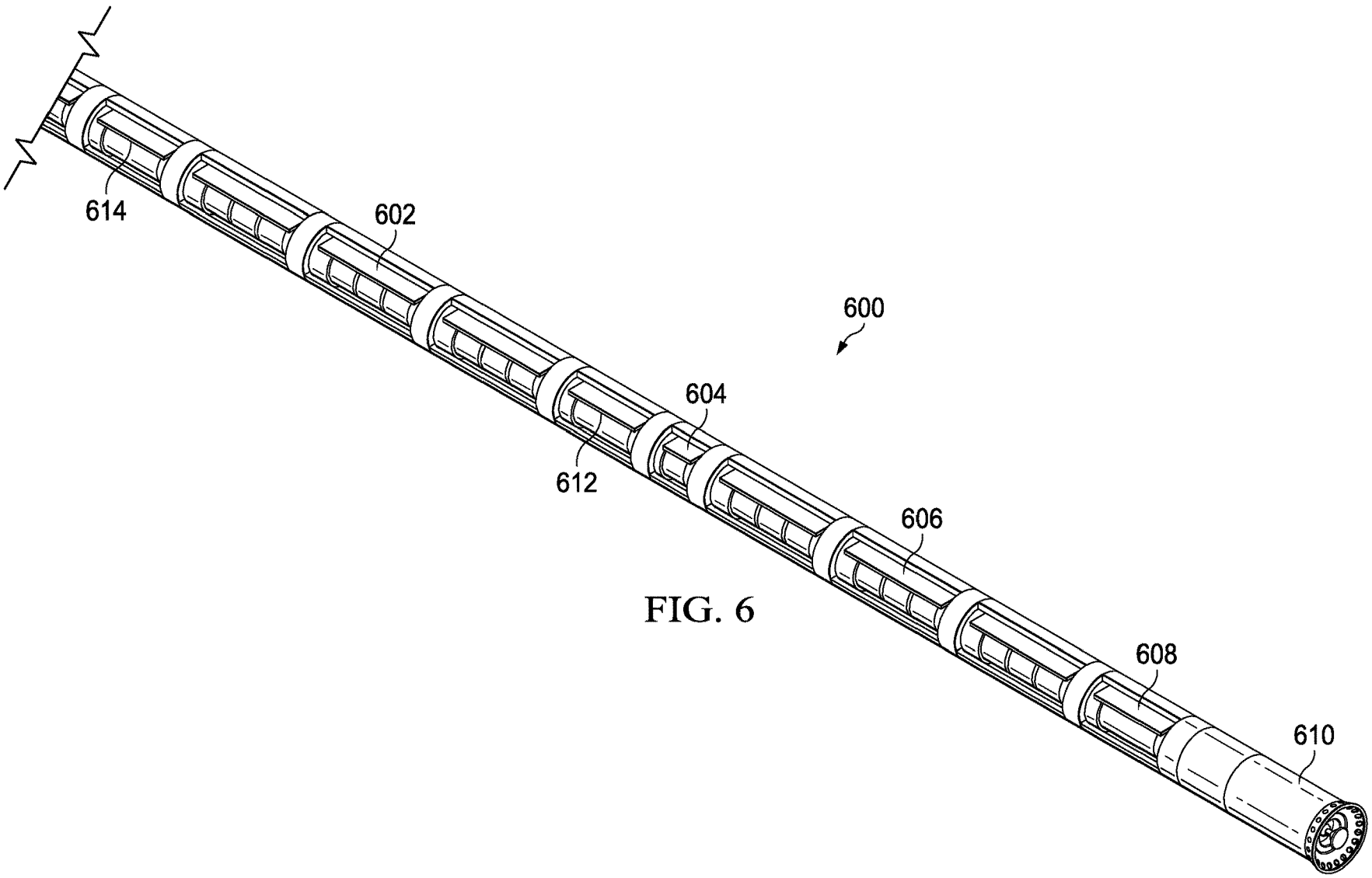
FIG. 6 is a perspective view of an exemplary bottom-hole assembly including a downhole pulse generation controller (PGC) associated with a PPD system.

FIG. 6 is a perspective view of an exemplary bottom-hole assembly associated with a PPD system. In this example, BHA 600 includes multiple components of a pulse power system, including pulse generation controller (PGC) 614, primary capacitor subassembly 602, transformer subassembly 604, secondary capacitor subassembly 606, inductor subassembly 608, and solid state switch subassembly 612, as well as drill bit 610. The pulse power system generates pulse drilling signals in the form of high-energy electrical pulses, and corresponding electrical arcs, required for pulsed-power drilling. Penetration of rock is achieved through the disintegrating effect of heat generated by the electric arcs at drill bit 610. The subassemblies and other elements illustrated in FIG. 6 may be arranged in a different order than that depicted in FIG. 6. A bottom-hole assembly may include more, fewer, or different elements than those depicted in FIG. 6.

Transformer subassembly 604 may include a segmented air core transformer including multiple primary windings and a single secondary winding. The pulse power system may include separate primary capacitors and corresponding switches for each of the primary windings, or segments. The primary capacitors may be charged, for example, by an alternator, from cable power supplied from the surface, from a fuel-cell, or by another mechanism. PGC 614 may be configured to control the timing with which switches within each segment are opened and closed to generate electrical pulses with particular characteristics. Under certain circumstances, PGC 614 may be adjusted to modify an operating parameter of a PD operation. For example, a PDC, such as PDC 500 illustrated in FIG. 5, may communicate a control signal to PGC 614 to disable one segment of the transformer or to change the relative timing of the switches in multiple segments of the transformer. An exemplary pulse power system including a PGC and a segmented primary transformer is illustrated in FIG. 7 and described below.

In a first operating mode, switches associated with all of the primary windings may fire simultaneously to switch the charged primary capacitors through the primary windings to produce a desired output pulse from the secondary winding. However, it may also be possible to refrain from firing particular ones of the switches to reduce the energy transmitted to the secondary capacitor or for other reasons. For example, the PDC may communicate a control signal to the pulse power system to adjust the timing of the firing of primary switches relative to each other through a certain range to modify the voltage rise time of the output pulse. The control signal may be generated, or initiated, by a PDC, such as PDC 500 illustrated in FIG. 5, in response to a change or predicted change in conditions for a PD operation or a change in the ROP or other drilling performance measurements for the PD operation. The control signal may be communicated to the pulse power system using any suitable communication protocol interfaces or telemetry mechanisms including, but not limited to, those described herein.

In a second operating mode, some of the switches of a segmented primary transformer may be fired earlier than other ones of the switches such that the waveform characteristics of the output pulse are modified, even if all the switches are fired. Such adjustments may be made in real time to provide control over the pulse characteristics and, indirectly, modify various operating parameters of a PD operation during the PD operation while the drill bit remains downhole. In another example, if one of the primary capacitors has failed, the PDC may cause a control signal to be communicated to the pulse power system indicating that the switch in the damaged segment should not be fired, thus taking one of the primary windings out of the pulse power circuit. Subsequently, the PD operation may continue using reduced pulse energy.

Figure 7:
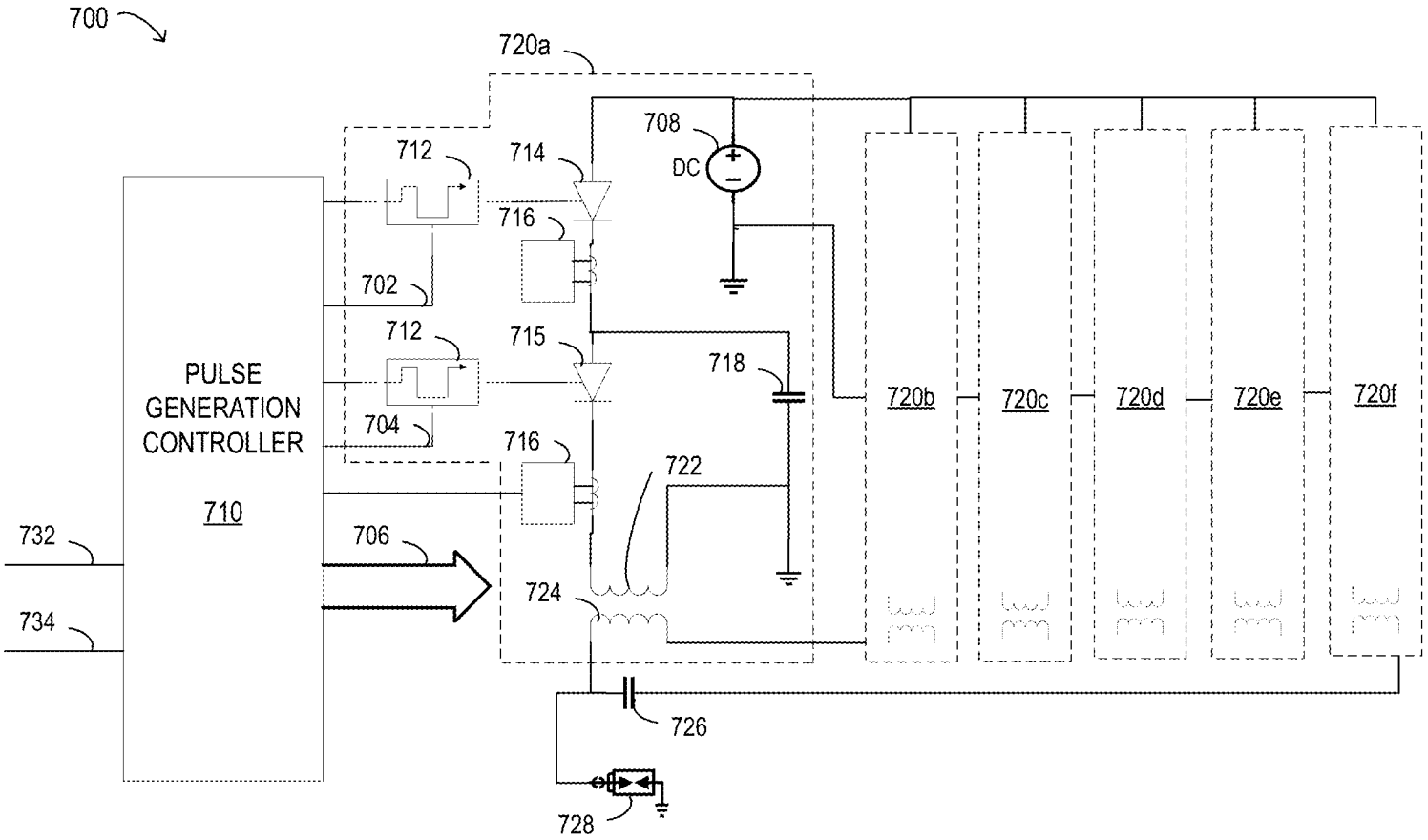
FIG. 7 is a circuit diagram illustrating selected elements of an exemplary pulse power system including a PGC and a segmented primary transformer.

FIG. 7 is a circuit diagram illustrating selected elements of an exemplary pulse power system including a PGC and a segmented primary transformer. In the illustrated example, pulse power system 700 includes PGC 710 and an air core transformer including multiple independently configurable primary winding circuits, or segments, 720. PGC 710 may be similar to PGC 614 illustrated in FIG. 6. In the illustrated example, the transformer includes six segments, shown as 720*a*-720*f*, each of which includes, among other elements, a respective primary winding 722, a respective primary capacitor 718, and two switches shown as 714 and 715. By dividing the primary winding circuit into six segments, the current flow through each of the switches is reduced to one-sixth of what it would be for a single primary winding with one large switch to conduct the entire primary pulse. Specifically, the peak current is reduced by a factor of six. In addition, the RMS current, which may be the limiting factor for certain types of switches, is also reduced by a factor of six. The transformer also includes DC power source 708 for charging the primary capacitors 718, a single secondary winding 724, a secondary capacitor 726, and a load 728.

In each segment 720, one of the switches (e.g., charging switch 714) is activated to charge the primary capacitor 718 and the other switch (e.g., discharging switch 715) is activated to discharge the primary capacitor 718 to the primary winding 722 to create an output pulse. Each of the charging switches 714 and discharging switches 715 may be implemented using a type of solid state switch or thyristor, e.g., a semiconductor-controlled rectifier or silicon controller rectifier (SCR), a silicon controlled switch (SCS), a bidirectional triode thyristor, a bilateral triode thyristor (TRIAC), a metal-oxide-semiconductor field-effect transistor (MOSFET), or an insulated-gate bipolar transistor (IGBT). Charging switches 714 and discharging switches 715 may be implemented as elements of a solid state switch subassembly, such as switch assembly 612 shown in FIG. 6. Charging switches 714 and discharging switches 715 may include locally intelligent circuitry configured to provide feedback about the state of pulse power system 700 to PGC 710 and/or a PDC such as PDC 155 illustrated in FIG. 1 or PDC 500 illustrated in FIG. 5.

In the illustrated example, PGC 710 may be configured to control the order and number of primary capacitors 718 that are charged at particular times. For example, by firing the charging switches 714 in the segments 720 at different times, different ones of the primary capacitors 718 may be charged at different times to reduce the peak load of pulse power system 700. Once all of the primary capacitors 718 have been charged, all of the discharging switches 715 may be fired at the same time to the secondary to create an output pulse.

In the illustrated example, each segment 720 also includes respective smart drivers 712 for charging switch 714 and discharging switch 715, and respective current sense amplifiers 716 associated with charging switch 714 and discharging switch 715. The smart drivers 712 may be configured to turn off a portion of the pulse power system circuitry under certain conditions. Each segment may receive two control signals from PGC 710. For segment 720*a*, these control signals are shown as charge control signal 702 and discharge control signal 704. Bus 706 represents respective pairs of charge control signals and discharge control signals for charging and discharging the respective primary capacitors 718 of segments 720*b*-720*f*.

PGC 710 may receive multiple types of inputs and may use those inputs to determine the relative timings with which to activate charging switches 714 and discharging switches 715 in each of the segments 720. For example, PGC 710 may receive local inputs 732, which may include signals representing measurements recorded by various downhole sensors that may affect the desired characteristics of the generated output pulses and/or feedback received from smart drivers 712, charging switches 714, discharging switches 715 or other elements of pulse power system 700. PGC 710 may be configured to automatically adjust the timing of the firing of various charging switches 714 or discharging switches 715 and/or the number of switches to be fired in response to local inputs 732. For example, PGC 710 may, based on received local inputs 732, detect a partial discharge condition or a full discharge condition, and may determine an appropriate timing pattern for firing various charging switches 714 and discharging switches 715 based on the detected condition. Pulse power system 700 may include, or receive measurements from, one or more downhole temperature sensors, and may be configured to shut down one or more segments 720 or to adjust the timing of the firing of various switches to reduce the pulse generation rate, and thus the drilling rate, in response to detecting that the PPD system is overheated. Pulse power system 700 may include, or receive measurements from, one or more depth sensors associated with the PPD system, and may be configured to adjust the timing of the firing of various switches to reduce the pulse generation rate, and thus the drilling rate, when the drill bit reaches a particular depth.

PGC 710 may also receive control signal inputs 734 from, for example, a PDC such as PDC 155 illustrated in FIG. 1 or PDC 500 illustrated in FIG. 5. For example, in response to a detected or predicted condition or a drilling performance measurement associated with a PD operation, PDC 500 may determine that an operating parameter of the PD operation should be modified, and may initiate the communication of a control signal to PGC 710 to cause an adjustment of pulse power system 700 to effect the desired operating parameter modification. PGC 710 may be configured to communicate with smart drivers 712, charging switches 714, discharging switches 715 and/or other CDCs of the PPD system and with a PDC at the surface, such as PDC 500 illustrated in FIG. 5, over respective Controller Area Network (CAN) busses (not shown). PGC 710 may receive control signal inputs 734 using any suitable communication protocol interfaces or telemetry mechanisms including, but not limited to, those described herein.

PGC 710 may be configured as a programmable multichannel pulse sequence generator that implements various timing functions and patterns with which charging switches 714 and discharging switches 715 are to be fired under particular conditions. PGC 710 may include a memory and a processor, which may include, without limitation, a microprocessor, microcontroller, digital signal processor (DSP), application specific integrated circuit (ASIC), or any other digital or analog circuitry configured to interpret and/or execute program instructions within the memory and/or process data (e.g., received inputs and/or data stored in the memory) to control timing functions in pulse power system 700. The memory may store program instructions for implementing multiple pre-programmed pulse generation modes, patterns, or recipes, which may be selectable using a control signal 734 received by PGC 710.

In one example, in response to determining, during a PD operation, that the drill bit is about to enter an abnormal pressure zone, and based on characterizations made using previously logged data, the PDC may determine that an adjustment should be made to the pulse power system to effect a reduction in the drilling rate. A control signal (e.g., in the form of an optical or electrical signal from the surface over an optical fiber, a wireline or a wired pipe, or a command from the surface telemetered via mud pulse, EM telemetry, acoustic telemetry, weight-set and/or flow rate toggling, or ball drop, or another type of control signal) may be communicated to PGC 710 to adjust the timing of the firing of various switches to reduce the pulse generation rate, and thus the drilling rate, without changing the shape of the pulses and without decreasing the volumetric flow rate.

Similarly, adjustments may be made to pulse power system 700 to tune a PD operation for particular formation layers and/or when crossing formation layer boundaries. In one example, if after drilling through hard sandstone, a PD operation crosses a formation layer boundary and begins drilling into shale, an analysis of the returned cuttings may indicate that the shale is being broken up into smaller cuttings than are desirable. A control signal may be communicated to PGC 710 indicating that the switches in two of the six segments should be disabled. In this case, the output voltage would be reduced to approximately two-thirds of the full circuit output voltage and the output pulse energy would be reduced to approximately two-thirds of the full circuit output pulse energy. Because of the resulting change in coupling in the transformer, there may be an additional decrease in efficiency of the circuit, in which case the reduction in output voltage and output energy may be slightly greater than predicted by a simple ratio. Once the two switches are disabled, the PD operation may continue but it may be running on approximately two-thirds of the energy used when drilling into hard sandstone, thus matching the pulse energy characteristics more closely to the formation properties. If the PD operation subsequently moves into another section of hard sandstone, as indicated by an analysis of the returned cuttings a control signal may be communicated to PGC 710 indicating that the two switches that were previously disabled should be enabled to return to full output energy.

Under certain circumstances including, but not limited to, when changing a pipe or performing another type of maintenance operation while the drill bit remains downhole, it may be appropriate to suspend a PD operation without replacing the circulating fluid. For example, instead of shutting down the fluid flow, a control signal may be communicated to the pulse power system to disable the switches in all segments of the transformer, causing drilling to cease. Subsequently, the drilling fluid may, briefly, continue to circulate from the distal end of the wellbore to the surface. A second control signal may be communicated downhole to cause the drilling fluid flow to be shut down to change the pipe. Once the pipe is changed, a third control signal may be communicated downhole to raise the fluid flow back up and, finally, a fourth control signal may be communicated to the pulse power system to enable the switches in all segments of the transformer, allowing drilling to resume.

The timing of the firing of the charging switches 714 and discharging switches 715 in different segments relative to each other may be adjusted to modify the shape of the output wave form of electrical pulses. The shape of the wave form may be modified to tune the PD operation for a particular formation. For example, a slower rise time in voltage may be more suitable when drilling into shale and a faster rise time in voltage may be more suitable when drilling into hard sandstone. In this example, if a small delay is introduced between the firings of the switches from one segment to the next, the rate of rise of voltage on the output capacitor decreases. In some cases, complex firing patterns may be implemented to generate output wave forms of complex shapes.

PGC 710 may be configured to shift between multiple pre-programmed pulse generation modes, each defining a pre-programmed timing pattern for firing the charging switches 714 and discharging switches 715 in segments 720*a*-720*f*, in response to receiving a control signal indicating that the pulse power system should be adjusted to implement a particular one of the pre-programed modes. Various pre-programmed drilling modes may cause a pulsed-power tool, such as pulsed-power tool 230 illustrated in FIG. 2, to drill faster or slower, may cause an adjustment to the size of cuttings produced, or may cause an adjustment to the caliper or smoothness of the wall of the wellbore being created via a particular timing sequence of pulsed power firings. Various drilling modes may be pre-programmed in anticipation of encountering formations of particular subterranean formation types for which one or another set of pulse parameters (e.g., voltages, wave forma, or pulse repetition rates) may be known to result in greater rock removal efficiency. Drilling modes may be pre-programmed to maintain drilling efficiency when encountering changes in mud properties (e.g., an increase in the percentage of water or an increase in the cuttings load) that may evolve over the course of a particular PD operation. Various drilling modes may be pre-programmed for increased or decreased power usage from the power source (e.g., to accommodate limitations or fluctuations in the available power from a turbine or generator, or to avoid taxing or over heating various electronic components).

Various relationships between individual controllable parameters and the resulting performance of a PD operation may inform the adjustments of particular CDCs that are initiated to change an operating parameter in the PPD system. These relationships may apply whether the adjustments are pre-programmed as part of a move from one operating mode to another operating mode or are initiated directly and explicitly by an adjustable tool component. In one example, if the repetition rate (e.g., the number of pulses per second) is increased from approximately 100 pulses per second to approximately 200 pulses per second, the ROP, as well as the power usage from the alternator or other power source, may be expected to increase correspondingly. This correspondence may be roughly linear. In addition, this adjustment may cause changes in the heat generation and taxing of components, which may also increase correspondingly, although not necessarily linearly.

In one example, one pre-programmed mode may define a sequence of switches to be fired and a timing pattern for firing the switches that results in a 20 microsecond rise time. Another pre-programmed mode may define a sequence of switches to be fired and a timing pattern for firing the switches that results in a 10 microsecond rise time. Some of the pre-programmed modes may define a sequence of switches to be fired that excludes the switches in one or more of the segments 720, thus reducing the energy of each pulse. Some of the pre-programmed modes may define a timing pattern for firing the switches that results in an adjustment of the repetition rate for various charging switches 714 and/or discharging switches 715. Adjusting the repetition rate for the firing of the switches, rather than changing which switches will be active, may allow the drilling rate to be modified independent of the fluid flow rate. Adjusting the number of switches that are fired may change the wave form because it changes the coupling to the transformer, which changes both the pulse energy and the rate of rise of voltage on the output capacitor. In the example illustrated in FIG. 7, the efficiency of the transformer may change when adjustments are made in the firing of the switches, but because the adjustments are only changing the primary side (which controls the energy that goes into the secondary capacitor and the rate of rise of voltage in the secondary capacitor), the rate of discharge might not change significantly. Rather, a change in the rate of discharge may be dependent on the rise time of the secondary voltage compared to the rise time of the secondary current in the arc initiated in the formation.

A drill bit including multiple lobes may have two or more separate pulse power systems, each driving a respective set of electrodes on one of the lobes. In this example, the pulse power systems may be independently adjusted to cause the respective pulsing characteristics of each lobe to be different. In one example, if a PGC of one of the pulse power systems is adjusted to increase the repetition rate of the pulses on one of the lobes, but the repetition rate is not increased for the other lobes, it may cause a modification of the drilling direction due to the increased generation of electrical arcs near the lobe for which the repetition rate was increased. In another example, adjustments may be made to reduce the energy on one of the lobes relative to the others by disabling the switches in one or more segments of a segmented primary transformer. In yet another example, a PDC (such as PDC 155 illustrated in FIG. 1 or PDC 500 illustrated in FIG. 5) may serve as a master controller issuing commands to the PGCs of multiple pulse power systems, each of which may include a segmented primary transformer. In this example, the PDC may configure each of the PGCs to implement any of a variety of sequences of switches to be fired and timing patterns for firing the switches that, collectively, optimizes one or more operating parameters of a PD operation in response to detected or predicted changes in conditions, changes in drilling performance measurements, or other factors.

Figure 8:
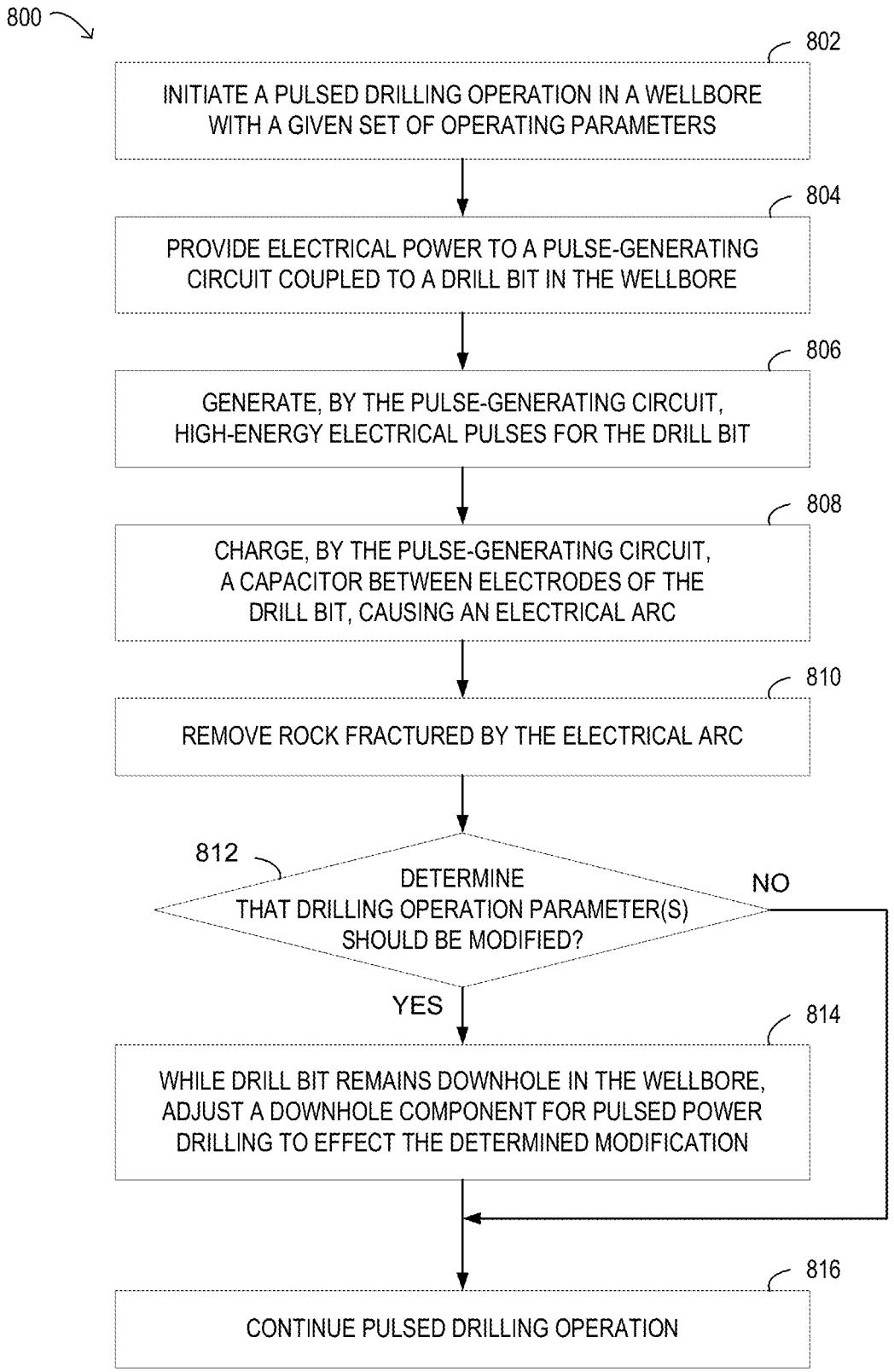
FIG. 8 is a flow chart illustrating an exemplary method for performing a pulsed drilling PD) operation.

FIG. 8 is a flow chart illustrating an exemplary method for performing a PD operation using a pulsed-power drill bit placed downhole in a wellbore. For example, drill bit 114 illustrated in FIG. 2A or drill bit 115 illustrated in FIG. 2B may be placed downhole in wellbore 116 as shown in FIG. 1. Some or all of the operations of method 800 may be performed, or initiated, by a PDC, such as PDC 155 illustrated in FIG. 1 or PDC 500 illustrated in FIG. 5.

Method 800 includes, at 802, initiating a PD operation in a wellbore with a set of operating parameters. For example, an initial set of operating parameters for the PD operation may be associated with one or more drilling modes and may include at least a pulse generation mode, a drilling rate, an arc path of pulses between and amongst electrodes, a volumetric flow rate, a drilling fluid velocity or directionality, a distribution of the flow of the drilling fluid at the drill bit, a rise time of an output pulse, a voltage or other electrical parameter associated with an output pulse, pulse repetition rate, a rate of penetration, and/or a desired characteristic of the cuttings.

At 804, electrical power is provided to a PG circuit coupled to the drill bit. For example, the PG circuit may be coupled to a first electrode and a second electrode of the drill bit. The first electrode may be electrode 208, 210, or 212 and the second electrode may be ground ring 250 discussed above with respect to FIGS. 2A and 2B. The PG circuit may be implemented within pulsed-power tool 230 shown in FIGS. 2A and 2B, and may receive electrical power from a power source on the surface, from a power source located downhole, or from a combination of a power source on the surface and a power source located downhole. Electrical power may be supplied downhole to a PG circuit by way of a cable, such as cable 220 described above with respect to FIGS. 2A and 2B. The power may be provided to the PG circuit within pulse-power tool 230 at a power source input.

At 806, high-energy electrical pulses, sometimes referred to as pulse drilling signals, are generated by the PG circuit for the drill bit by converting the electrical power received from the power source into high-energy electrical pulses. For example, the PG circuit may use electrical resonance to convert a low-voltage power source (for example, approximately 1 kV to approximately 5 kV) into high-energy electrical pulses capable of applying at least 60 kV across electrodes of the drill bit.

At 808, the PG circuit charges a capacitor between electrodes of the drill bit, causing an electrical arc. The switch may be a mechanical switch, a solid-state switch, a magnetic switch, a gas switch, or any other type of switch. Accordingly, as the voltage across the capacitor increases, the voltage across the first electrode and the second electrode increases. As described above with reference to FIGS. 1, 2A and 2B, when the voltage across the electrodes becomes sufficiently large, an electrical arc may form through the drilling fluid and/or a rock formation that is proximate to the electrodes. The arc may provide a temporary electrical short between the electrodes, and thus may discharge, at a high current level, the voltage built up across the output capacitor. A switch located downhole within the PG circuit may close to discharge a capacitor through a transformer to charge an output capacitor that is electrically coupled between the first electrode and the second electrode. The switch may close to generate a high-energy electrical pulse and may be open between pulses.

As described above with reference to FIGS. 1, 2A and 2B, the electrical arc greatly increases the temperature and the pressure of the portion of the rock formation in the immediate vicinity of the electrical arc, such that the rock formation at the distal end of the wellbore may be fractured with the electrical arc. The temperature may be sufficiently high to vaporize any water or other fluids that may be touching or near the arc and may also vaporize part of the rock. The vaporization process creates a high-pressure plasma which expands and, in turn, fractures the surrounding rock. At 810, rock fractured by the electrical arc may be removed from the distal end of the wellbore. For example, as described above with reference to FIG. 1, drilling fluid 122 may move the fractured rock away from the electrodes and uphole from the drill bit. As described above with respect to FIGS. 2A and 2B, drilling fluid 122 and the fractured rock may flow away from electrodes through fluid flow ports 260 on the face of the drill bit or on a ground ring of the drill bit.

At 812, the method includes determining whether or not one or more operating parameters of the PD operation should be modified. For example, a determination that a modification of one or more operating parameters may be made may be based at least on logging data (including, but not limited to, measurements representing responses recorded by various acoustic, electrical or electromagnetic sensors during PD operations), characteristics of analyzed cuttings, drilling performance measurement data, and/or feedback returned from various CDCs of the PPD system.

If it is determined that one or more operating parameters of the PD operation should be modified, a CDC for pulsed power drilling is adjusted to effect the determined operating parameter modification while the drill bit remains downhole in the wellbore, at 814. In one example, the PDC may communicate a control signal directly to a CDC to be adjusted to effect a desired change from a first operating parameter of the PD operation to a second operating parameter for the PD operation. In another example, the PDC may communicate a control signal to an intermediate downhole component (e.g., an electrical or mechanical actuator, or a PGC) that causes a desired change from a first operating parameter of the PD operation to a second operating parameter for the PD operation. In either case, the control signal may be communicated using any suitable communication protocol interfaces or telemetry mechanisms including, but not limited to, those described herein to effect a desired operating parameter modification. For example, the control signal may be communicated using mud pulse telemetry, electromagnetic telemetry, or acoustic telemetry.

At 812, if it is determined that no operating parameters of the PD operation should be modified, the PD operation continues at 816 using the initial set of operating parameters without modification. Alternatively, if a determined modification has been made at 814, the PD operation continues using the modified operating parameter.

Modifications, additions, or omissions may be made to method 800 without departing from the scope of the disclosure. For example, the order of the steps may be performed in a different manner than that described and some steps may be performed at the same time. Additionally, each individual step may include additional steps without departing from the scope of the present disclosure. The operations of method 800 illustrated in FIG. 8 may be repeated, as needed, to perform a PD operation.

The systems and methods described herein may be used to modify at least one operating parameter in an initial operating parameter set for a PD operation to better optimize a drilling performance measurement associated with the PD operation, or for other purposes, e.g., to modify the direction of the drilling, to modify the size of the hole being formed, or to modify the operational state of the drilling tool. For example, when a PD operation moves from drilling a first type of rock to a second type of rock, there may be multiple operating parameters that could be modified to optimize the operation for the second type of rock, including the drilling rate or the output pulse energy. Because the nature of the cuttings will impact the challenges faced when cleaning up the mud at the surface, adjustments may be made to CDCs to modify the coarseness of the cuttings. For example, if the returned cuttings are too small (e.g., if the cuttings consist primarily of a fine powder rather than appropriately sized chunks of rock, such as quarter inch chunks), an on-the-fly adjustment may be made to fine tuning the PD operation.

Figure 9:
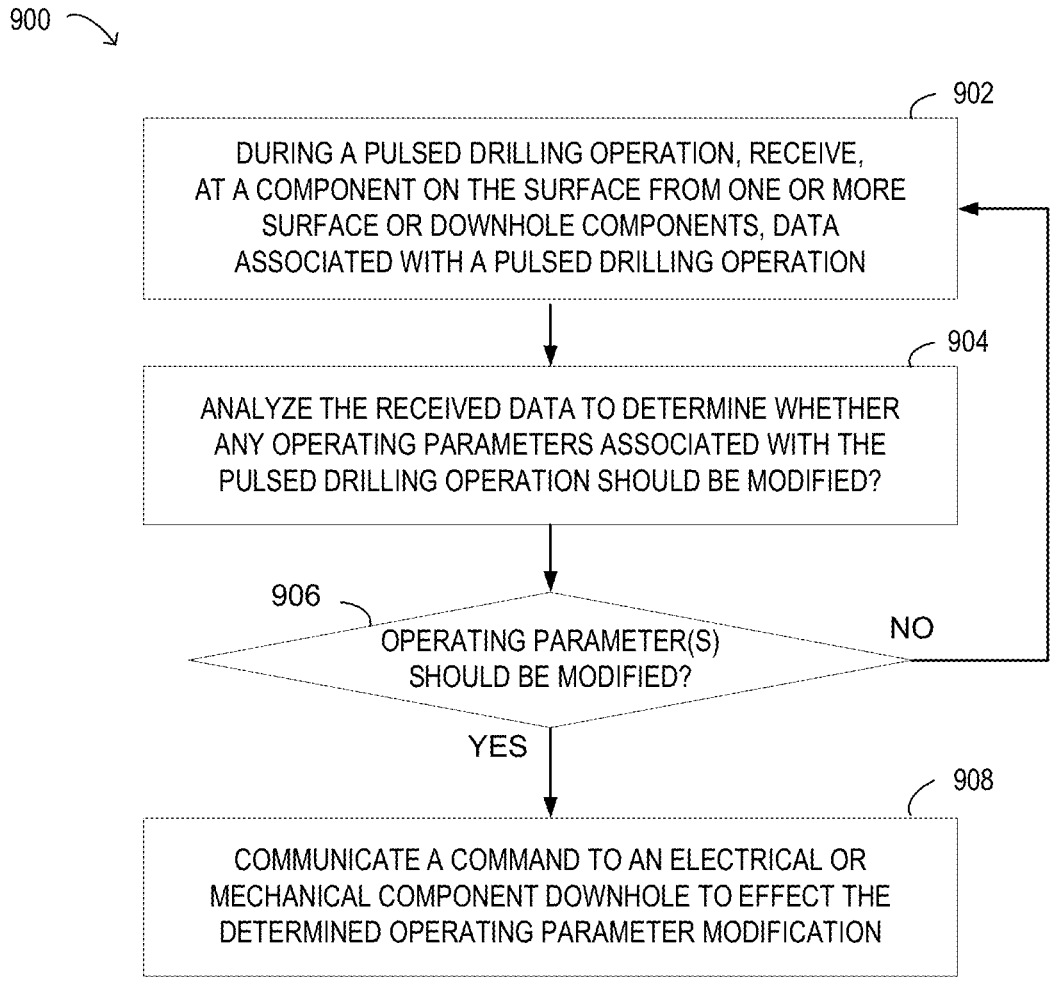
FIG. 9 is a flow chart illustrating an exemplary method for initiating a modification of an operating parameter associated with a pulsed drilling (PD) operation.

FIG. 9 is a flow chart illustrating an exemplary method for initiating a modification of an operating parameter associated with a PD operation. For example, method 900 may be used to initiate a change from a first operating parameter of the PD operation to a second operating parameter of the PD operation. Method 900 may be performed by a PDC, such as PDC 155 illustrated in FIG. 1 or PDC 500 illustrated in FIG. 5. At 902, method 900 includes, at a component on the surface, receiving from one or more surface or downhole components during a PD operation, data associated with a PD operation. For example, as discussed above with reference to FIG. 4, a PDC may receive measurements representing responses recorded by various acoustic, electrical or electromagnetic sensors including, but not limited to, received signals representing pulse drilling signals in the form of high-energy electrical pulses or acoustic and/or electromagnetic waves produced by the electrical arcs during a PD operation. This logging data may include data captured in real time during the PD operation and/or logging data previously obtained when drilling through a similar type of material. The PDC may receive data representing certain characteristics of cuttings including, but not limited to, data indicative of the minerology of the formation (e.g., whether it is shale or hard sandstone), data indicative of the size or coarseness of the cuttings, data indicative of the brittleness of the cuttings, data indicative of the confining stress field (e.g., whether it is a high, medium, or low confining stress) data indicative of the depth from which the cuttings were obtained and/or data indicative of the hydrostatic pressure (e.g., the floor pressure) at the location from which the cuttings were obtained. The PDC may also receive drilling performance measurement data, and/or other feedback returned from various downhole components of the PPD system.

At 904, the received data is analyzed to determine whether any operating parameters associated with the PD operation should be modified. In one example, an analysis of the received data may yield a determination or prediction of a change in the type of rock being drilled, which may inform a decision to modify one or more operating parameter of the PD operation to optimize the operation for the alternate rock type, as described herein. In another example, an analysis of the ROP or another drilling performance measurement may inform a decision to modify one or more operating parameter of the PD operation to improve the performance of the drilling operation, as described herein. In yet another example, if particular switches were disabled when drilling through shale, it may be appropriate to re-energize the previously disabled switches when subsequently drilling through harder rock in order to increase the ROP.

The operating parameters to be modified for the PD operation may be associated with one or more drilling modes and may include at least a pulse generation mode, a drilling rate, an arc path of pulses between and amongst electrodes, a volumetric flow rate for drilling fluid, a drilling fluid velocity or directionality, a distribution of the flow of the drilling fluid at the drill bit, a rise time of an output pulse, a voltage or other electrical parameter associated with an output pulse, pulse repetition rate, a rate of penetration, and/or a desired characteristic of the cuttings.

If, at 906, it is determined that no operating parameters associated with the PD operation should be modified, the PD operation may continue using the current operating parameters. This may include continuing to receive data associated with the PD operation, as in 902, and continuing to analyze the received data to determine whether any operating parameters associated with the PD operation should be modified, as in 904.

At 906, if (or once) it is determined that one or more operating parameters associated with the PD operation should be modified, a command is communicated to a downhole electrical, mechanical, or hydraulic component for the PD operation to effect the determined operating parameter modification, as shown at 908. In one example, the PDC may communicate a control signal directly to a CDC to be adjusted to effect a desired operating parameter modification. In another example, the PDC may communicate a control signal to an intermediate downhole component (e.g., an electrical or mechanical actuator, or a PGC) using any suitable communication protocol interfaces or telemetry mechanisms including, but not limited to, those described herein to effect a desired operating parameter modification.

In one example, the systems described herein may implement a rudimentary direct control of a controllable parameter associated with a CDC. For example, mechanically toggling a mechanical device that is directly linked to a CDC such as a valve (e.g., using a weight-set method and/or a pressure set method) may directly result in increasing or decreasing a drilling fluid flow path associated with the valve. In another example, a rudimentary toggling of the mechanical configuration of an electrical device (e.g., the shifting of sets of windings with respect to each other) may directly result in a change to an electrical characteristic of the electrical device. Using various indirect control mechanisms, a control signal implemented using an optical fiber, a wireline, a mud pulse, a wired pipe, or EM or acoustic telemetry may be received or detected downhole, as is appropriate for each such telemetry approach. For example, a downhole pressure sensor may receive or detect a mud pulse. The control signal may then be interpreted by a downhole processor, which initiates a command via an electrical signal to a controllable downhole device.

Modifications, additions, or omissions may be made to method 900 without departing from the scope of the disclosure. For example, the order of the steps may be performed in a different manner than that described and some steps may be performed at the same time. Additionally, each individual step may include additional steps without departing from the scope of the present disclosure. The operations of method 900 illustrated in FIG. 9 may be repeated, as needed, to perform a PD operation.

Figure 10:
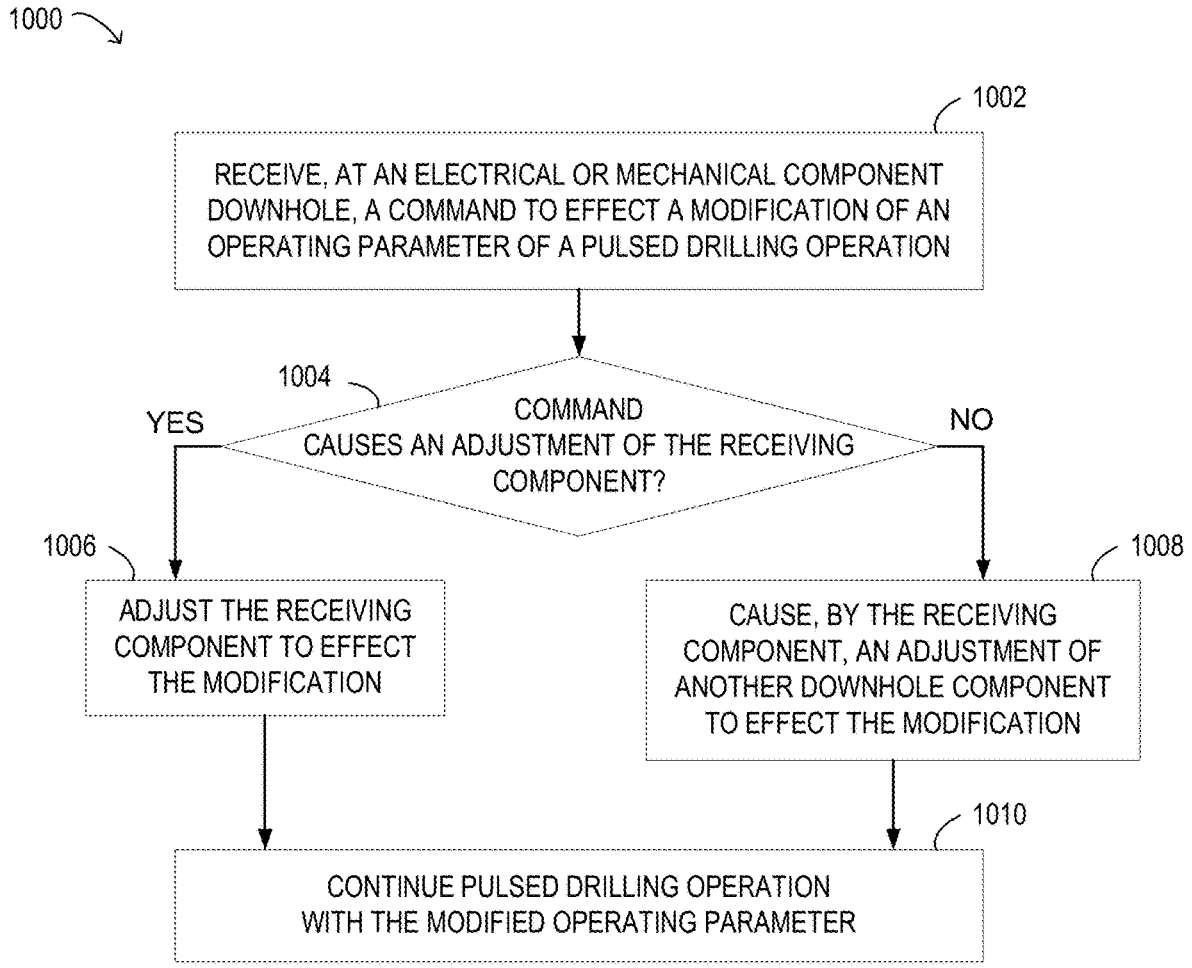
FIG. 10 is a flow chart illustrating an exemplary method for modifying an operating parameter associated with a PD operation.

FIG. 10 is a flow chart illustrating an exemplary method for modifying an operating parameter associated with a PD operation. For example, method 1000 may be used to cause a change from a first operating parameter of the PD operation to a second operating parameter of the PD operation. Method 1000 includes, at 1002, receiving, at an electrical or mechanical component downhole, a command to effect a modification of an operating parameter of a PD operation. For example, a control signal generated by a PDC located at the surface or downhole may be received directly from the PDC by a CDC to effect a desired operating parameter modification. In another example, a control signal may be received by the CDC from an intermediate downhole component (e.g., an electrical or mechanical actuator, or a PGC) to effect a desired operating parameter modification.

If, at 1004, the received command is a command directed to the CDC that receives the command to cause an adjustment of the receiving component, the receiving component is adjusted to effect the desired operating parameter modification, as shown in 1006. For example, the CDC to be adjusted may be a drill bit (e.g., in which the position or orientation of an electrode or ground ring is to be adjusted), a pulse power system (in which a PGC is to be adjusted), or another component of a bottom-hole assembly for which adjustments can be initiated using a control signal received directly from a PDC located at the surface or downhole.

If, at 1004, the command is received by a downhole component other than a CDC that is the target of the command, the receiving component causes an adjustment of another CDC to effect the desired operating parameter modification, as shown in 1008. For example, the receiving component may be a PGC that receives a control signal indicating a pulse generation mode and that adjusts a sequence of transformers switches or a timing pattern for firing the switches to effect a modification of an operating parameter, as described herein. In another example, the receiving component may be an electrical or mechanical actuator that translates a control signal to initiate an adjustment of the targeted CDC to effect the desired operating parameter modification, as described herein. The adjustment may include adjusting the position of a mechanical or solid state switch in the pulse power system or another configurable component, opening or closing a valve to control the flow rate or path of drill fluid or to create pressure pulses, adjusting the position or orientation of an electrode or ground ring of a drill bit, or making any other suitable adjustment to a CDC to effect a modification of an operating parameter of a PD operation. At 1010, the PD operation continues, using the modified operating parameter.

Modifications, additions, or omissions may be made to method 1000 without departing from the scope of the disclosure. For example, the order of the steps may be performed in a different manner than that described and some steps may be performed at the same time. Additionally, each individual step may include additional steps without departing from the scope of the present disclosure. The operations of method 1000 illustrated in FIG. 10 may be repeated, as needed, to perform a PD operation.

Figure 11:
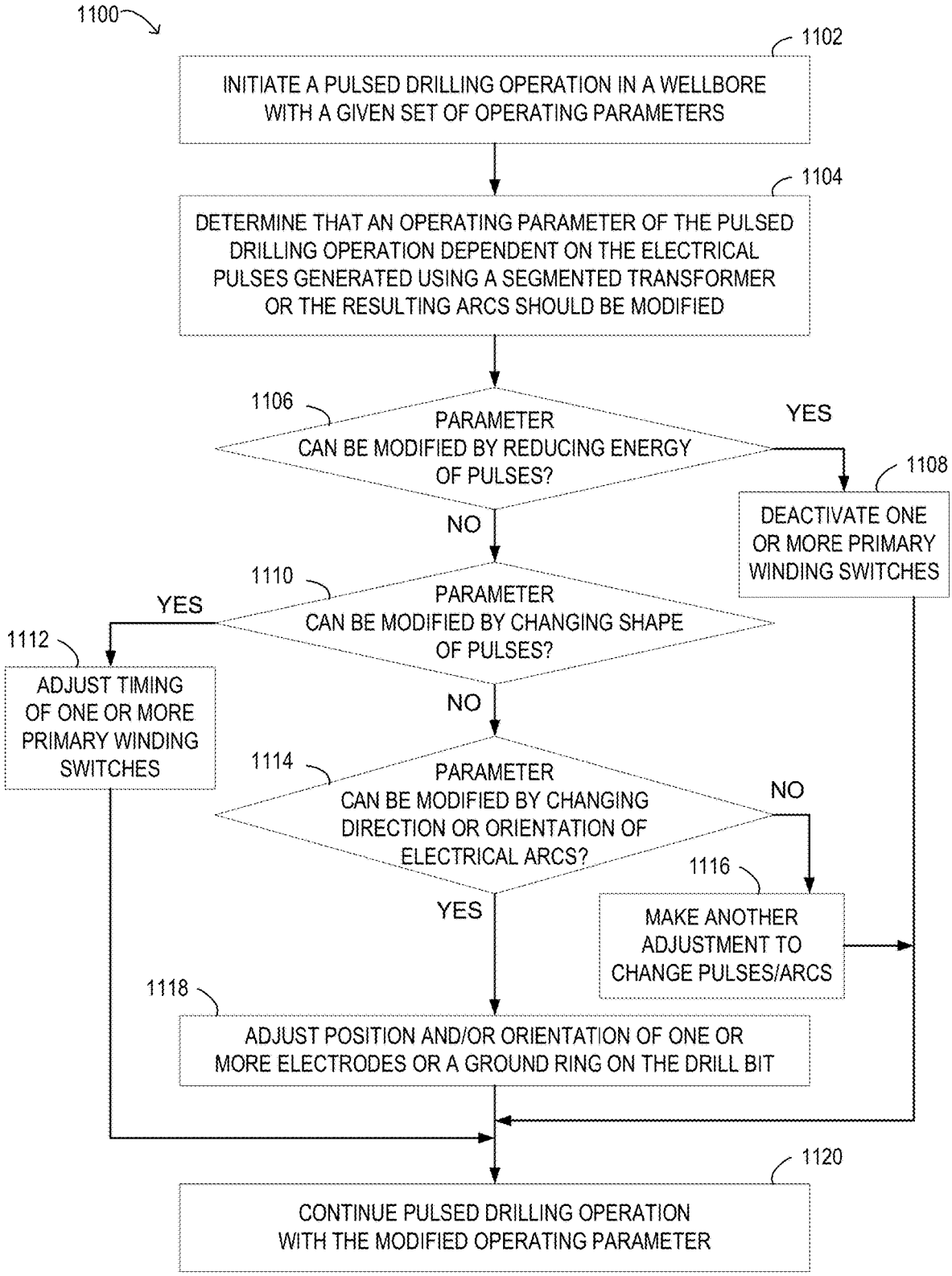
FIG. 11 is a flow chart illustrating an exemplary method for effecting a modification of an operating parameter that is dependent on electrical pulses or resulting electrical arcs generated during a PD operation.

FIG. 11 is a flow chart illustrating an exemplary method for effecting a modification of an operating parameter that is dependent on electrical pulses or resulting electrical arcs generated by a pulse power system during a PD operation. For example, method 1100 may be used to cause a change from a first operating parameter of the PD operation to a second operating parameter of the PD operation The pulse power system may include a PGC, such as PGC 710, and a primary segmented transformer, such as the transformer illustrated in FIG. 7 and described above. Method 1100 may be performed by a PDC, such as PDC 155 illustrated in FIG. 1 or PDC 500 illustrated in FIG. 5, in conjunction with a PGC.

Method 1100 includes, at 1102, initiating a PD operation in a wellbore with a set of operating parameters. For example, an initial set of operating parameters for the PD operation may be associated with one or more drilling modes and may include at least a pulse generation mode, a drilling rate, an arc path of pulses between and amongst electrodes, a volumetric flow rate, a drilling fluid velocity or directionality, a distribution of the flow of the drilling fluid at the drill bit, a rise time of an output pulse, a voltage or other electrical parameter associated with an output pulse, pulse repetition rate, a rate of penetration, and/or a desired characteristic of the cuttings.

At 1104, a determination is made that an operating parameter of the PD operation controlled by the electrical pulses generated by the PG circuit or by the resulting arcs should be modified. For example, a determination that a modification of one or more operating parameters should be made may be based at least on logging data (including, but not limited to, measurements representing responses recorded by various acoustic, electrical or electromagnetic sensors during PD operations), characteristics of analyzed cuttings, performance measurement data, and/or feedback returned from various CDCs of the PPD system.

If, at 1106, it is determined that the operating parameter can be modified by reducing the energy of the electrical pulses generated by the PG circuit, one or more of the primary winding switches may be deactivated in order to reduce the energy and effect the determined operating parameter modification, as shown in 1108.

If, at 1110, it is determined that the operating parameter can be modified by changing the shape of the electrical pulses generated by the PG circuit, the timing of one or more primary winding switches may be adjusted to modify the shape of the electrical pulses and effect the determined operating parameter modification, as shown in 1112.

If, at 1114, it is determined that the operating parameter can be modified by changing the direction or orientation of the electrical arcs resulting from the electrical pulses, the position and/or orientation of one or more electrodes on the drill bit, a ground ring on the drill bit, a conductive element on the drill bit, or an insulator on the drill bit may be adjusted in order to modify the direction or orientation of the electrical arcs and effect the determined operating parameter modification, as shown in 1118. Otherwise, another suitable adjustment is made to effect the determined operating parameter modification, at 1116. For example, a sequence of primary winding switches to be fired or a repetition rate at which the primary winding switches are fired may be adjusted to effect a particular operating parameter modification.

Once the operating parameter modification has been made, the PD operation continues, using the modified operating parameter, as shown in 1120.

Modifications, additions, or omissions may be made to method 1100 without departing from the scope of the disclosure. For example, the order of the steps may be performed in a different manner than that described and some steps may be performed at the same time. Additionally, each individual step may include additional steps without departing from the scope of the present disclosure. The operations of method 1100 illustrated in FIG. 11 may be repeated, as needed, to perform a PD operation.

A PPD system may support multiple selectable drilling modes for PD operations, each of which defines a respective set of operating parameters. For example, each drilling mode may define one or more of a pulse generation mode, a drilling rate, an arc path of pulses between and amongst electrodes, a volumetric flow rate, a drilling fluid velocity or directionality, a distribution of the flow of the drilling fluid at the drill bit, a rise time of an output pulse, a voltage or other electrical parameter associated with an output pulse, pulse repetition rate, a rate of penetration, and/or a desired characteristic of the cuttings. If a determination is made to change the drilling mode of a PD operation while it is ongoing, multiple CDCs may need to be adjusted to effect multiple modifications to respective operating parameters of the PD operation. For example, some drilling modes may be associated with a single operating parameter, allowing various combinations of other operating parameters as long as the single operating parameter is met, while other drilling modes may be associated with two or more operating parameters.

Figure 12:
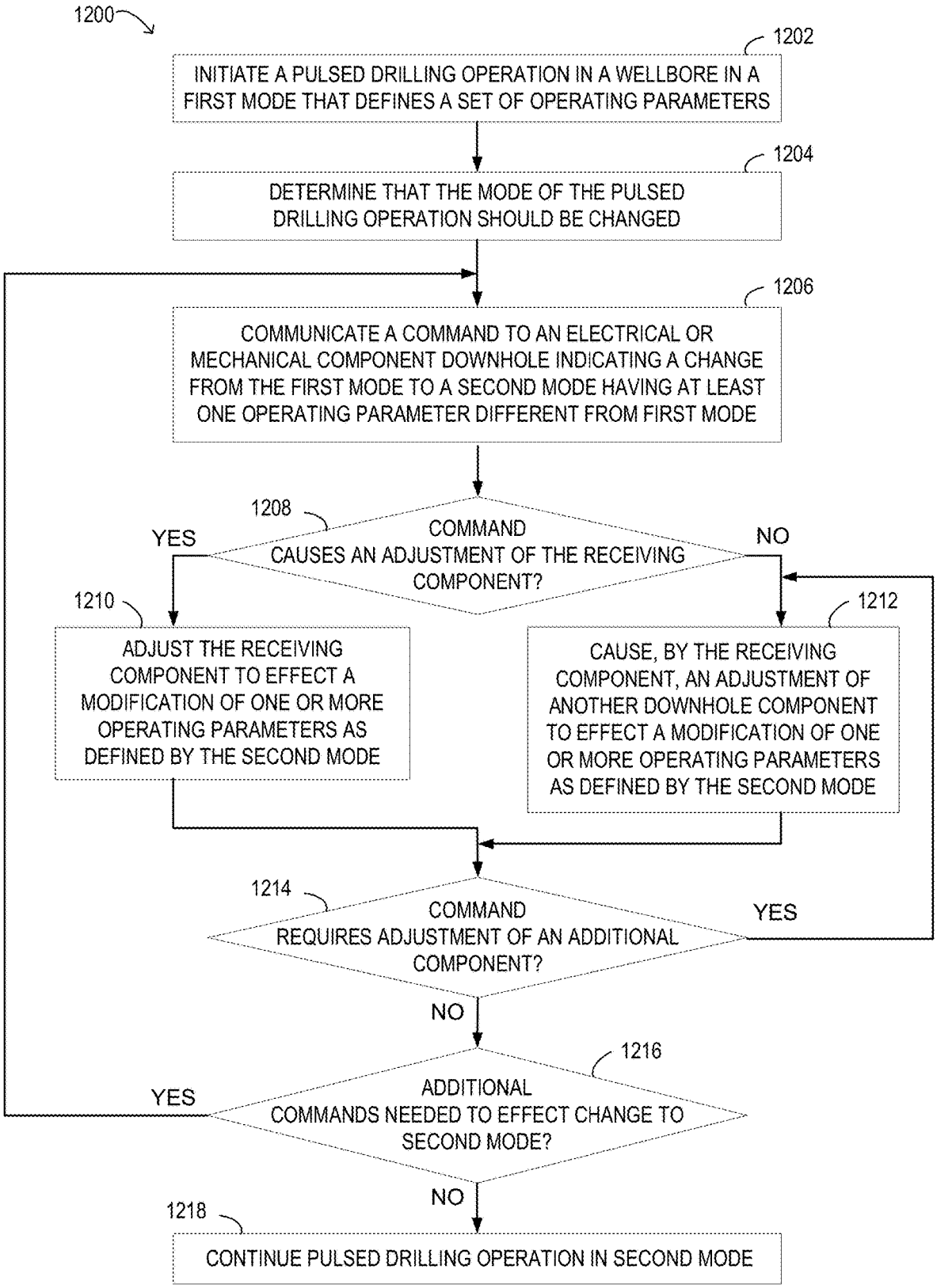
FIG. 12 is a flow chart illustrating an exemplary method for effecting a mode change for a PD operation.

FIG. 12 is a flow chart illustrating an exemplary method for effecting a mode change for a PD operation. For example, method 1200 may cause a change from a first operating parameter associated with a first drilling mode to a second operating parameter associated with a second drilling mode, and may also cause a change from a third operating parameter associated with the first drilling mode to a fourth operating parameter associated with the second drilling mode. At least some of the operations of method 1200 may be performed by a PDC, such as PDC 155 illustrated in FIG. 1 or PDC 500 illustrated in FIG. 5.

Method 1200 includes, at 1202, initiating a PD operation in a wellbore in a first mode for which a set of operating parameters is defined. At 1204, it is determined that the mode of the PD operation should be changed. For example, a determination that the mode of the PD operation should be changed may be based at least on logging data (including, but not limited to, measurements representing responses recorded by various acoustic, electrical or electromagnetic sensors during PD operations), characteristics of analyzed cuttings, performance measurement data, and/or feedback returned from various downhole components of the PPD system. A drilling mode change may be indicated when the PD operation crosses, or is predicted to cross, a formation layer boundary, for example, or when a drilling performance measurement indicates that the PD operation should be better tuned for the current drilling conditions.

At 1206, a command is communicated to an electrical or mechanical component downhole indicating a change from the first mode to a second mode, where the second mode includes at least one operating parameter that is different from the operating parameters defined for the first mode. For example, the PDC may communicate a control signal directly to a CDC to cause an adjustment of the downhole component and an operating parameter modification associated with the desired drilling mode change, or a control signal may be communicated to an intermediate downhole component (e.g., an electrical or mechanical actuator, or a PGC) using any suitable communication protocol interfaces or telemetry mechanisms including, but not limited to, those described herein to effect to effect an operating parameter modification associated with the desired drilling mode change.

At 1208, if the command causes an adjustment of the receiving component, the receiving component is adjusted to effect a modification of one or more operating parameters as defined for the second mode, as shown in 1210. Otherwise, the receiving component causes an adjustment of another CDC to effect a modification of one or more operating parameters as defined by the second mode, as shown in 1212. In one example, the receiving component may be a PGC that receives a control signal indicating a pulse generation mode and that adjusts a sequence of transformers switches or a timing pattern for firing the switches to effect a modification of an operating parameter associated with the desired mode change. In another example, the receiving component may be an electrical or mechanical actuator that translates a control signal to initiate an adjustment of the targeted CDC to effect a modification of an operating parameter associated with the desired mode change. The adjustment may include adjusting the position of a switch, opening or closing a valve, adjusting the position or orientation of an electrode or ground ring of a drill bit, or making any other suitable adjustment to a CDC to effect a modification of an operating parameter of a PD operation.

If, at 1214, it is determined that the command requires an adjustment of an additional component, the receiving component causes an adjustment of yet another CDC to effect a modification of one or more operating parameters as defined by the second mode, as shown in 1212. The operations illustrated as 1212 and 1214 may be repeated one or more times, as necessary, to cause adjustments necessitated by the received command.

If, at 1216, it is determined that one or more additional commands are needed in order to effect the change to the second mode, the operations illustrated as 1206 to 1214 may be repeated one or more times, as necessary, to communicate the additional commands to particular CDCs and to make the appropriate adjustments to those components necessitated by the receipt of the additional commands.

Once all of the adjustments of CDCs necessitated by the mode change have been made, the PD operation continues in the second mode, as shown in 1218.

Modifications, additions, or omissions may be made to method 1200 without departing from the scope of the disclosure. For example, the order of the steps may be performed in a different manner than that described and some steps may be performed at the same time. Additionally, each individual step may include additional steps without departing from the scope of the present disclosure. The operations of method 1200 illustrated in FIG. 12 may be repeated, as needed, to perform a PD operation.

As described herein, a PPD system may include various mechanisms to perform downhole reconfigurations of drilling system components during PD operations without removing the CDCs to be adjusted from the wellbore. These adjustments may be made in real time to modify an operating parameter in response to changing conditions or performance measurements. The ability to modify the operating parameters of a PD operation while it is in progress may reduce the number of times that all or a portion of the drill string is removed from the wellbore in order to make adjustments to CDCs for pulsed power drilling, as well as increase the ROP achieved during PD operations or improve other performance measurements. The techniques described herein may also certain elements of the drilling operation to be decoupled from the mud flow.

The PPD systems described herein may include, as the electric power source, a downhole turbine that converts hydraulic energy to a rotation of an alternator, which creates electric power. In some cases, a load interaction, such as an excessive load at the drill bit, may cause issues with the turbine and may draw too much out of the flow, hydraulically. In response, an adjustment may be made to a CDC to reduce the effects of the excessive load on the flow. For example, if the flow needs to be increased without generating too much electrical power downhole, an adjustment may be made to draw only a portion of the power that can potentially be created. For example, by changing the repetition rate of the switches, rather than changing which switches will be active, the drilling rate may be modified independent of the flow.

A pulsed drilling controller may be operable to effect an operating parameter modification by causing an adjustment to a single-use component. For example, a PPD system may include burst plates, burst disks, or other expendable components that, when no longer needed, or in order to change an operating mode, may be mechanically broken to effect a modification that cannot be undone. A pulsed drilling controller may communicate a control signal to a downhole mechanical actuator to break the one-shot component.

While techniques for performing downhole reconfigurations of drilling system components during PD operations without removing the CDCs to be adjusted from the wellbore are described herein primarily in terms of their application in electrocrushing drilling, these techniques may also be used in systems that implement electrohydraulic drilling or that include a hybrid bit. For example, a hybrid bit may include an electrocrushing bit in an inner section and a drag bit in an outer section. The electrocrushing bit may be used to cut out the center of a wellbore, while the drag bit (which may be more efficient at high peripheral velocity than in a center position) may be used to cut out the formation around the outside of the center cut. In this example, at least some of the techniques for performing downhole reconfigurations of configurable components described herein may be applied to the hybrid bit to optimize the drilling of the center of the wellbore using the electrocrushing bit in the inner section.

Embodiments herein may include:

A. A pulsed drilling controller (PDC) including a processor and a computer readable storage medium storing program instructions that when read and executed by the processor cause the processor to cause an adjustment of a configurable downhole component (CDC) for pulsed power drilling, while a pulsed-power drill bit remains in a wellbore, to effect a change from a first operating parameter of a pulsed drilling (PD) operation to a second operating parameter of the PD operation and to cause the PD operation to continue using the second operating parameter.

B. A method of drilling a wellbore including adjusting a first configurable downhole component (CDC) for pulsed power drilling, while a pulsed-power drill bit remains in the wellbore, to effect a change from a first operating parameter of a pulsed drilling (PD) operation to a second operating parameter of the PD operation and continuing the PD operation using the second operating parameter.

C. A pulsed-power drilling system including a configurable downhole component (CDC), a pulsed-power drill bit including a first electrode and a second electrode electrically coupled to a pulse-generating (PG) circuit to receive pulse drilling signals from the PG circuit causing at least 60 kv to be applied across the first and second electrodes during a pulsed drilling (PD) operation in a wellbore, and a pulsed drilling controller communicatively coupled to the drill bit and to the CDC.

Each of embodiments A, B and C may have one or more of the following additional elements in any combination:

Element 1: wherein the first operating parameter is one of a plurality of operating parameters associated with a first drilling mode; and the second operating parameter is one of a plurality of operating parameters associated with a second drilling mode. Element 2: adjusting a second CDC to effect a change from a third operating parameter of the PD operation associated with the first drilling mode to a fourth operating parameter associated with the second drilling mode; and continuing the PD operation using the second operating parameter and the fourth operating parameter. Element 3: configuring the first CDC to use the first operating parameter. Element 4: analyzing sensor data received from a downhole sensor. Element 5: analyzing cuttings returned from downhole to the surface during the PD operation. Element 6: analyzing formation data indicating a characteristic of cuttings returned from downhole to the surface during the PD operation. Element 7: determining the change from the first operating parameter of the PD operation to the second operating parameter of the PD operation dependent on the analyzing. Element 8: wherein adjusting the first CDC includes communicating a control signal to the first CDC to cause the adjustment. Element 9: wherein adjusting the first CDC includes initiating an operation of a downhole electrical actuator or a downhole mechanical actuator to cause the adjustment. Element 10: wherein the control signal is communicated to the first CDC using acoustic telemetry, electromagnetic telemetry or mud pulse telemetry. Element 11: wherein the PG circuit includes a segmented transformer including multiple primary windings each associated with a respective primary capacitor having a respective primary switch. Element 12: wherein adjusting the first CDC includes initiating an operation of a PGC associated with the segmented transformer. Element 13: wherein adjusting the first CDC includes initiating at least one of a change in position or orientation of the first electrode, a change in position or orientation of the second electrode, a change in position or orientation of a ground ring in the pulsed-power drill bit, a change in position of a conductive element in the pulsed-power drill bit, and a change in position of an insulator in the pulsed-power drill bit. Element 14: wherein the PG circuit includes a first capacitor in parallel with an alternator and electrically coupled to the alternator through a first electrical switch; a transformer in parallel with the first capacitor, a primary side of the transformer electrically coupled to the first capacitor through a second electrical switch; and a second capacitor in parallel with the transformer and in parallel with the drill bit, the second capacitor electrically coupled to a secondary side of the transformer and electrically coupled to the first and second electrodes of the drill bit. Element 15: wherein the PG circuit includes an inductor in parallel with an alternator and electrically coupled to the alternator through an electrical switch; and a capacitor in parallel with the inductor and in parallel with the drill bit, the capacitor electrically coupled to the first and second electrodes of the drill bit. Element 16: wherein the PG circuit includes an inductor in parallel with an alternator and electrically coupled to the alternator through a first electrical switch; a first capacitor in parallel with the inductor and in parallel with a transformer, the first capacitor electrically coupled to a primary side of the transformer through a second electrical switch; and a second capacitor in parallel with the transformer and in parallel with the drill bit, the second capacitor electrically coupled to a secondary side of the transformer and electrically coupled to the first and second electrodes of the drill bit. Element 17: wherein adjusting the CDC includes initiating at least one of toggling a state of an electrical switch in the PG circuit, modifying a time at which a state of an electrical switch in the PG circuit is toggled, modifying a rate at which a state of an electric switch in the PG circuit is toggled, and modifying a time at which a state of a first electrical switch in the PG circuit is toggled relative to a time at which a state of a second electrical switch in the PG circuit is toggled. Element 18: wherein the second operating parameter of the PD operation includes at least one of a drilling mode, a pulse generation mode, a drilling rate, an arc path of pulses between the first and second electrodes, a volumetric drilling fluid flow rate, a drilling fluid velocity, a drilling fluid path, a drilling fluid distribution at the drill bit, a voltage rise time of a pulse drilling signal generated by the PG circuit, a rate of penetration, and a desired characteristic of cuttings returned from downhole to the surface during the PD operation.

Although the present disclosure has been described with several embodiments, various changes and modifications may be suggested to one skilled in the art. It is intended that the present disclosure encompasses such various changes and modifications as falling within the scope of the appended claims.

What is claimed is:

1. A pulsed-power drilling system, comprising:

a pulsed-power drill bit including a first electrode and a second electrode;

a pulse-generating (PG) circuit configured to provide pulse drilling signals that cause an electric potential in the range of 60 kv to 300 kv, inclusive, to be applied across the first and second electrodes during a pulsed drilling (PD) operation in a wellbore;

the PG circuit comprising a segmented transformer including multiple primary windings, wherein each of the multiple primary windings is associated with a respective independently configurable primary winding circuit including a charge switch, a primary capacitor, and a discharge switch; and a pulse generation controller (PGC) coupled to independently control the charge switch and the discharge switch of each of the respective independently configurable primary winding circuits associated with the multiple primary windings to generate an output pulse across the first and second electrodes.

2. The pulsed-power drilling system of claim 1, wherein:

the PGC includes a control input coupled to receive a control signal from a surface-level pulsed drilling controller, the PGC configured to control the discharge switch of each of the respective independently configurable primary winding circuits based on the control signal.

3. The pulsed-power drilling system of claim 1, wherein:

the PGC includes a local input coupled to receive a local control signal representing information from one or more downhole sensors, the PGC configured to control the discharge switch of each of the respective independently configurable primary winding circuits based on the local control signal.

4. The pulsed-power drilling system of claim 1, wherein:

the PGC is programmed to control the discharge switch of each of the respective independently configurable primary winding circuits based on a control signal responsive to at least one of a pressure of a zone of a formation, a drilling depth, a temperature measurement, a directional drilling measurement, a wellbore roughness measurement, a formation evaluation measurement, a volumetric rate of cuttings, a characteristic of cuttings, a distribution of cuttings size, or a compositional measurement of a returned drilling fluid.

5. The pulsed-power drilling system of claim 1, wherein:

the PGC is configured to control a number of the discharge switches of the respective independently configurable primary winding circuits to be activated during generation of the output pulse to control at least one of the voltage or energy of the output pulse.

6. The pulsed-power drilling system of claim 1, wherein:

the PGC is configured to control a sequence of the discharge switches of the respective independently configurable primary winding circuits to be activated during generation of the output pulse to control the shape of the output pulse.

7. The pulsed-power drilling system of claim 1, wherein:

the PGC is configured to control a repetition rate for activating the discharge switches of one or more of the respective independently configurable primary winding circuits to control the repetition rate of the output pulse.

8. The pulsed-power drilling system of claim 1, wherein:

the PGC is configured to adjust the output pulse responsive to a cuttings size.

9. The pulsed-power drilling system of claim 1, wherein:

the PGC is configured to adjust the output pulse responsive to a rate of penetration.

10. A method, comprising:

independently controlling each of a plurality of charge switches to respectively charge each of a plurality of primary capacitors associated with a respective primary winding of a segmented transformer;

determining a pulse-generation mode for independently activating a plurality of discharge switches respectively associated with the plurality of primary capacitors; and independently activating each of the plurality of discharge switches to discharge the plurality of primary capacitors according to the pulse-generation mode such that an output pulse is applied across first and second electrodes of a pulsed-power drill bit.

11. The method of claim 10, further comprising:

receiving a control signal from a surface-level pulsed drilling controller; and selecting the pulse-generation mode based on the received control signal.

12. The method of claim 10, further comprising:

receiving a local control signal representing information from one or more downhole sensors; and selecting the pulse-generation mode based on the received control signal.

13. The method of claim 10, further comprising:

receiving a control signal responsive to at least one of a pressure of a zone of a formation, a drilling depth, a temperature measurement, a directional drilling measurement, a wellbore roughness measurement, a formation evaluation measurement, a volumetric rate of cuttings, a characteristic of cuttings, a distribution of cuttings size, or a compositional measurement of a returned drilling fluid; and selecting the pulse-generation mode based on the received control signal.

14. The method of claim 10, further comprising:

controlling a number of the plurality of discharge switches to be activated during generation of the output pulse to control at least one of the voltage or energy of the output pulse.

15. The method of claim 10, further comprising:

controlling a sequence of the plurality of discharge switches to be activated during generation of the output pulse to control the shape of the output pulse.

16. The method of claim 10, further comprising:

controlling a repetition rate for activating the plurality of discharge switches to control the repetition rate of the output pulse.

17. The pulsed-power drilling system of claim 16, wherein when read and executed by the processor, the program instructions further cause the processor to:

control a number of the plurality of the respective discharge switches to be activated during generation of the output pulse to control at least one of the voltage or energy of the output pulse.

18. The pulsed-power drilling system of claim 16, wherein when read and executed by the processor, the program instructions further cause the processor to:

control a sequence of the plurality of the respective discharge switches to be activated during generation of the output pulse to control the shape of the output pulse.

19. The pulsed-power drilling system of claim 16, wherein when read and executed by the processor, the program instructions further cause the processor to:

control a repetition rate for activating the plurality of the respective discharge switches to control the repetition rate of the output pulse.

20. The pulsed-power drilling system of claim 16, wherein when read and executed by the processor, the program instructions further cause the processor to:

modify the pulse-generation mode to adjust the output pulse in response to a control signal responsive to cuttings size.

21. The pulsed-power drilling system of claim 16, wherein when read and executed by the processor, the program instructions further cause the processor to:

modify the pulse-generation mode to adjust the output pulse in response to a control signal responsive to a rate of penetration.

22. The method of claim 10, further comprising:

modifying the pulse-generation mode to adjust the output pulse responsive to a cuttings size.

23. The method of claim 10, further comprising:

modifying the pulse-generation mode to adjust the output pulse responsive to a rate of penetration.

24. A pulsed-power drilling system, comprising:

a pulsed-power drill bit including a first electrode and a second electrode;

a pulse-generating (PG) circuit configured to provide pulse drilling signals that cause an electric potential in the range of 60 kv to 300 kv, inclusive, to be applied across the first and second electrodes during a pulsed drilling (PD) operation in a wellbore;

the PG circuit comprising a segmented transformer including multiple primary windings, wherein each of the multiple primary windings is associated with a respective independently configurable primary winding circuit including a charge switch, a primary capacitor, and a discharge switch; and a pulse generation controller (PGC) communicatively coupled to the PG circuit to control the charge switch and the discharge switch of each of the respective independently configurable primary winding circuits associated with the multiple primary windings to generate an output pulse across the first and second electrodes, the PGC comprising:

a processor; and a computer readable storage medium storing program instructions that when read and executed by the processor cause the processor to:

independently control each of a plurality of the charge switches to respectively charge each of a plurality of the primary capacitors;

determine a pulse-generation mode for independently activating each of a plurality of the respective discharge switches; and independently activate each of the plurality of discharge switches to discharge the plurality of primary capacitors according to the pulse-generation mode.

25. The pulsed-power drilling system of claim 24, wherein when read and executed by the processor, the program instructions further cause the processor to:

receive a control signal from a surface-level pulsed drilling controller; and select the pulse-generation mode based on the received control signal.

26. The pulsed-power drilling system of claim 16, wherein when read and executed by the processor, the program instructions further cause the processor to:

receive a local control signal representing information from one or more downhole sensors; and select the pulse-generation mode based on the received local control signal.

27. The pulsed-power drilling system of claim 16, wherein when read and executed by the processor, the program instructions further cause the processor to:

receive a control signal responsive to at least one of a pressure of a zone of a formation, a drilling depth, a temperature measurement, a directional drilling measurement, a wellbore roughness measurement, a formation evaluation measurement, a volumetric rate of cuttings, a characteristic of cuttings, a distribution of cuttings size, or a compositional measurement of a returned drilling fluid; and select the pulse-generation mode based on the control signal.

* * * * *